US009694599B2

(12) United States Patent
Sakano et al.

(10) Patent No.: US 9,694,599 B2
(45) Date of Patent: Jul. 4, 2017

(54) TAPE PRINTING DEVICE AND TAPE PRINTING SYSTEM

(71) Applicant: Seiko Epson Corporation, Tokyo (JP)

(72) Inventors: Hideki Sakano, Matsumoto (JP); Hideo Sodeyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/122,292

(22) PCT Filed: Mar. 19, 2015

(86) PCT No.: PCT/JP2015/001549
§ 371 (c)(1),
(2) Date: Aug. 29, 2016

(87) PCT Pub. No.: WO2015/146095
PCT Pub. Date: Oct. 1, 2015

(65) Prior Publication Data

US 2016/0368275 A1 Dec. 22, 2016

(30) Foreign Application Priority Data

Mar. 24, 2014 (JP) ..... 2014-060911
Mar. 24, 2014 (JP) ..... 2014-060913
(Continued)

(51) Int. Cl.
*B41J 2/325* (2006.01)
*B41J 3/407* (2006.01)
(Continued)

(52) U.S. Cl.
CPC ..... *B41J 2/325* (2013.01); *B41J 2/32* (2013.01); *B41J 3/4075* (2013.01); *B41J 32/00* (2013.01)

(58) Field of Classification Search
CPC ... B41J 32/00; B41J 17/32; B41J 17/36; B41J 2/325; B41J 35/28
See application file for complete search history.

(56) References Cited

U.S. PATENT DOCUMENTS 5,921,688 A 7/1999 Furuya et al.
2009/0080959 A1 3/2009 Shiraiwa et al.

FOREIGN PATENT DOCUMENTS

JP 07-314868 A 12/1995
JP 9-277679 A 10/1997
(Continued)

OTHER PUBLICATIONS

International Search Report, International Application No. PCT/JP2015/001549, Jun. 2, 2015.

*Primary Examiner* — Kristal Feggins
(74) *Attorney, Agent, or Firm* — ALG Intellectual Property, LLC

(57) ABSTRACT

A tape printing device or the like in which the misalignment of a loaded tape cartridge can be restrained is provided. A tape printing device includes: a cartridge loading section in which a tape cartridge is loaded; a platen drive shaft which outputs a forward rotational force to feed a print tape of the loaded tape cartridge; a take-up drive shaft which outputs a reverse rotational force to take up an ink ribbon of the loaded tape cartridge; and a main body-side abutting portion which is provided in the cartridge loading section and abuts against the tape cartridge so as to resist the rotational forces generated on the tape cartridge by the platen drive shaft and the take-up drive shaft.

11 Claims, 15 Drawing Sheets

(30) Foreign Application Priority Data

Aug. 1, 2014 (JP) ..... 2014-157991
Jan. 20, 2015 (JP) ..... 2015-008460

(51) Int. Cl.
*B41J 32/00* (2006.01)
*B41J 2/32* (2006.01)

(56) References Cited

FOREIGN PATENT DOCUMENTS

| | | | |
|---|---|---|---|
| JP | 2011-206910 | A | 10/2011 |
| JP | 2012-20543 | A | 2/2012 |
| WO | WO-2012-008126 | A | 1/2012 |

TAPE PRINTING DEVICE AND TAPE PRINTING SYSTEM

CROSS-REFERENCE TO RELATED APPLICATIONS

This application is the U.S. National Phase under 35 U.S.C. §371 of International Application No. PCT/JP2015/001549 filed on Mar. 19, 2015, which in turn claims the benefit of Japanese Application No. 2014-060911 filed on Mar. 24, 2014, Japanese Application No. 2014-060913 filed on Mar. 24, 2014, Japanese Application No. 2014-157991 filed on Aug. 1, 2014, and Japanese Application No. 2015-008460 filed on Jan. 20, 2015, the disclosures of which are expressly incorporated by reference herein.

TECHNICAL FIELD

The present invention relates to a tape printing device and a tape printing system for printing on a print tape of a loaded tape cartridge.

BACKGROUND ART

As a tape printing device of this type in which a tape cartridge is loaded, the following device is known (see JP-2012-20543).

This tape cartridge includes a tape member made up of a print tape wound on a tape core, a ribbon member made up of an ink ribbon wound on a ribbon reel-off core, a ribbon take-up core which takes up the ink ribbon after use, a platen roller which reels off and feeds the print tape from the tape member, and a cartridge case which accommodates the tape member, the ribbon member, the ribbon take-up core and the platen roller.

Meanwhile, the tape printing device has a cartridge loading section in which the tape cartridge is loaded in an unloadable manner. Also, in the cartridge loading section, a positioning protrusion for positioning the tape core, a print head covered by a head cover, a platen drive shaft which causes the platen roller to rotate, a ribbon take-up drive shaft which takes up the ink ribbon via the ribbon take-up core are provided on a bottom plate. Also, in the space below the cartridge loading section, a motor-driven tape feed mechanism which causes the platen drive shaft and the ribbon take-up drive shaft to rotate is arranged inside.

SUMMARY

In such a tape cartridge according to the related art, in the state of being loaded in cartridge loading section, a rotational force acts on the platen roller from the platen drive shaft in feeding the print tape and the ink ribbon. Similarly, a rotational force acts on the ribbon take-up core from the ribbon take-up drive shaft in the take-up of the ink ribbon. Due to the friction between the platen roller and its bearing part, a part of the rotational force inputted to the platen roller acts as a moment of rotation on the cartridge case via the bearing part. Similarly, a part of the rotational force inputted to the ribbon take-up core acts as a moment of rotation on the cartridge case.

In this case, the platen roller rotates clockwise as viewed in a plan view, and the ribbon take-up core rotates counter-clockwise as viewed in a plan view. Therefore, a force resulting from combining the moment of rotation on the platen roller side and the moment of rotation on the ribbon take-up core side acts on the tape cartridge. Since this resultant force has no vector components such that the respective rotational forces cancel each other on an imaginary line connecting the platen roller and the ribbon take-up core, the rotational forces are superimposed on each other on the imaginary line in a direction intersecting with the imaginary line, thus acting as the largest force. Therefore, when the tape printing device is driven for printing, there is a risk of the tape cartridge being misaligned inside the cartridge loading section. Also, the misalignment of the tape cartridge causes misalignment with respect to the print head and therefore adversely affects the print quality.

An object of the invention is to provide a tape printing device and a tape printing system in which the misalignment of the loaded tape cartridge can be restrained.

A tape printing device according to the invention includes: a cartridge loading section in which a tape cartridge is loaded; a first output unit which is provided in the cartridge loading section and outputs a forward rotational force to feed a print tape of the loaded tape cartridge; a second output unit which is provided in the cartridge loading section and outputs a reverse rotational force to take up an ink ribbon of the loaded tape cartridge; and a main body-side abutting portion which is provided in the cartridge loading section and abuts against the loaded tape cartridge so as to resist the rotational forces generated on the tape cartridge by the first output unit and the second output unit.

In this case, it is preferable that the main body-side abutting portion is arranged on or near an imaginary line connecting the first output unit and the second output unit.

According to this configuration, the tape cartridge abuts against the main body-side abutting portion so as to resist the rotational forces generated on the tape cartridge by the first output unit and the second output unit. Therefore, the force generated by the rotational forces of the first output unit and the second output unit causes the tape cartridge and the main body-side abutting portion of the cartridge loading section to abut against each other with a strong force and stabilizes the positional relation with each other. Also, since the main body-side abutting portion exists substantially on the imaginary line (including its vicinity) connecting the first output unit and the second output unit, there are no vector components such that the respective rotational forces cancel each other at this position on the imaginary line and therefore the respective rotational forces have a maximum value. That is, using a rotational force which causes misalignment, the misalignment of the tape cartridge inside the cartridge loading section can be restrained. Therefore, the print quality can be stabilized.

Also, it is preferable that the first output unit has a platen drive shaft which rotationally drives a platen roller of the tape cartridge for feeding the print tape, and that the second output unit has a take-up drive shaft which rotationally drives a take-up core of the tape cartridge for taking up the ink ribbon.

According to this configuration, even when the tape cartridge receives forward and reverse rotational forces from the platen drive shaft and the take-up drive shaft, the misalignment of the tape cartridge can be restrained by the main body-side abutting portion.

Also, it is preferable that the tape printing device further includes a print head unit which is provided in the cartridge loading section and performs printing on the print tape, and a head cover which covers the print head unit, and that the main body-side abutting portion is provided in a protruding manner in a corner of the head cover and abuts against a corner of an opening circumferential wall portion of the tape cartridge where the head cover is inserted.

According to this configuration, as the main body-side abutting portion provided in a protruding manner in the corner of the head cover and the corner of the opening circumferential wall portion of the tape cartridge mesh with each other, misalignment in a direction intersecting with the protruding main body-side abutting portion can be restrained as well.

In this case, it is preferable that the print head unit has a print head and a swivel support shaft which supports the print head in such a way as to be able to swivel between a printing position and a retreat position, that the head cover has a first cover sidewall and a second cover sidewall which cover the side of the swivel support shaft and meet each other, and that the main body-side abutting portion is provided in a protruding manner in a corner where the first cover sidewall and the second cover sidewall meet each other.

According to this configuration, since the main body-side abutting portion is provided in a protruding manner in the high-strength corner between the first cover sidewall and the second cover sidewall, this corner can be made to function as a reinforcing part of the main body-side abutting portion. Therefore, even when the main body-side abutting portion has a small cross-sectional area, the strength of the main body-side abutting portion can be maintained in order to resist the above rotational forces.

In this case, it is preferable that a cartridge-side abutting portion is provided in a recessed manner in the corner of the opening circumferential wall portion, corresponding to the main body-side abutting portion, and that the main body-side abutting portion is relatively fitted with the cartridge-side abutting portion.

According to this configuration, the tape cartridge can be positioned in the cartridge loading section via the recessed/protruding meshed shape of the cartridge-side abutting portion and the main body-side abutting portion. Also, even if a force other than the above rotational forces acts, the misalignment of the tape cartridge in the cartridge loading section can be prevented.

In this case, it is preferable that the main body-side abutting portion has, in the corner, a first abutting protrusion provided in a protruding manner on the first cover sidewall, and a second abutting protrusion provided in a protruding manner on the second cover sidewall, and that the first abutting protrusion is fitted with a first abutting recess of the cartridge-side abutting portion, whereas the second abutting protrusion is fitted with a second abutting recess on the cartridge-side abutting portion.

According to this configuration, with the first abutting protrusion and the second abutting protrusion, the tape cartridge can be accurately positioned in the cartridge loading section. Also, even if a force other than the above rotational forces acts, the misalignment of the tape cartridge in the cartridge loading section can be prevented.

Meanwhile, it is preferable that the tape printing device further includes a guide protrusion which is provided in a protruding manner on an outer circumferential surface of the head cover and guides the loading of the tape cartridge via a recess to be guided which is formed in the tape cartridge.

According to this configuration, the tape cartridge is guided by the guide protrusion provided in a protruding manner on the outer circumferential surface of the head cover, in the loading into the cartridge loading section. Therefore, the tape cartridge can be smoothly loaded in a correct loading posture. Also, the tape cartridge can be smoothly loaded even if a large space is not provided between the head cover and the tape cartridge. Therefore, the entry of dust and misalignment can be restrained without impairing the guiding function for the loading into the cartridge loading section.

In this case, it is preferable that the recess to be guided is relatively fitted with the guide protrusion.

According to this configuration, the tape cartridge can be positioned in the cartridge loading section via the guide protrusion and the recess to be guided. Thus, the print quality can be stabilized.

Also, it is preferable that the head cover is situated on a back side of the print head, and further includes a third cover sidewall opposite the first cover sidewall, and a fourth cover sidewall opposite the second cover sidewall, that the third cover sidewall extends in a direction that is the same as a direction of feeding the print tape, and that the guide protrusion has a third protrusion provided in a protruding manner on an outer surface of the third cover sidewall.

Incidentally, as the print head unit moves and presses the platen roller provided in the tape cartridge, a pressing force acts on the tape cartridge via the platen roller.

According to this configuration, since the tape cartridge is positioned by the guide protrusion of the third cover sidewall situated on the back side of the print head unit, the pressing force of the print head unit is received by the guide protrusion via the tape cartridge. That is, since the pressing force of the print head unit is absorbed by the head cover, which covers the print head unit, this pressing force does not cause any misalignment of the tape cartridge. Therefore, the print quality can be stabilized.

Moreover, it is preferable that the guide protrusion has a second protrusion provided in a protruding manner on an outer surface of the second cover sidewall, and a fourth protrusion provided in a protruding manner on an outer surface of the fourth cover sidewall.

Incidentally, as the platen roller nips the print tape and the ink ribbon with the print head unit and starts rotating (tape feeding), a rotational force around the platen roller acts on the cartridge case.

According to this configuration, since the tape cartridge is positioned by the second protrusion and the fourth protrusion, the rotational force around the platen roller is received by the second protrusion and the fourth protrusion spaced apart from each other, via the tape cartridge. That is, since the rotational force around the platen roller is restrained by the head cover, the misalignment of the tape cartridge due to this rotational force is retrained. Therefore, the print quality can be stabilized.

A tape printing system according to the invention includes: the above tape printing device; and a tape cartridge loaded in the cartridge loading section in an unloadable manner.

According to this configuration, since the misalignment of the tape cartridge loaded in the cartridge loading section of the tape printing device is restrained, the print quality in the tape printing device can be stabilized.

DESCRIPTION OF EXEMPLARY EMBODIMENTS

Hereinafter, a tape printing device and a tape printing system according to an embodiment of the invention will be described, referring to the accompanying drawings. This tape printing device is configured to perform printing while reeling off a print tape and an ink ribbon from a tape cartridge loaded therein, and cut a printed part of the print tape, thus preparing a label (tape piece). Also, the tape printing system is made up of this tape printing device and a tape cartridge loaded and used therein.

[Outline of Tape Printing Device]

Figure 1:
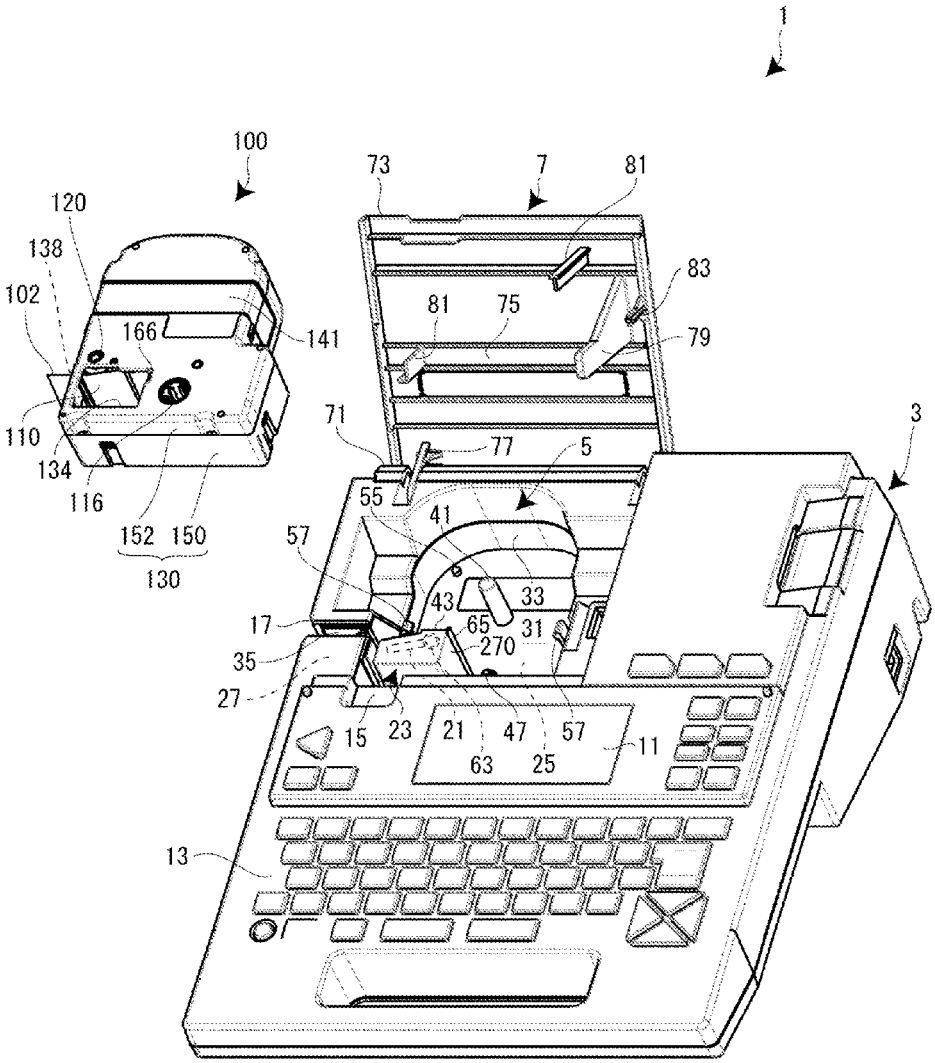
FIG. 1 is an external perspective view of a tape printing device (in an open-cover state) and a tape cartridge that form a tape printing system according to an embodiment.

FIG. 1 is an external perspective view of a tape printing device and a tape cartridge loaded therein, forming a tape printing system. As shown in FIG. 1, a tape printing device 1 includes a device case 3 forming an outer shell, a cartridge loading section 5 in which a tape cartridge 100 is loaded in an unloadable manner, and an open/close cover 7 which opens and closes the cartridge loading section 5. On a top surface of the device case 3, the cartridge loading section 5 is provided on the rear side, a display 11 is provided in the center, and a keyboard 13 is provided on the forward side. A dent portion 15 to hook a finger is provided near the open/close cover 7. The open/close cover 7 is opened by having a finger hooked on this dent portion 15 and lifting up the open/close cover 7. Then, on a lateral side (left side) of the device case 3, a vertically long tape discharge port 17 through which a print tape 102 is discharged is provided.

Also, the tape printing device 1 includes a print mechanism section 23 having a print head 21 provided upright in the cartridge loading section 5, a tape feed mechanism section 25 provided inside the space on the back of the cartridge loading section 5, and a tape cutting mechanism section 27 provided inside near the tape discharge port 17. The user inputs print information from the keyboard 13, confirms the print information on the display 11, and subsequently executes printing by a key operation. As a print command is given, the tape feed mechanism section 25 is driven, thus causing the print tape 102 and an ink ribbon 110 to travel in parallel. Moreover, due to the heat applied to the ink ribbon 110 from the print mechanism section 23, the ink of the ink ribbon 110 is thermally transferred to the print tape 102, thus carrying out printing. By this print feed, the print tape 102 is discharged from the tape discharge port 17. When the printing is completed, the tape cutting mechanism section 27 is driven, thus cutting the printed part of the print tape 102.

[Outline of Tape Cartridge]

As shown in FIGS. 2A, 2B, 5A, and 5B, the tape cartridge 100 includes a tape roll 106 having the print tape 102 wound on a tape core 104, and a ribbon roll 114 having the ink ribbon 110 wound on a reel-off core 112. Also, the tape cartridge 100 includes a take-up core 116 which takes up the ink ribbon 110 after use, and a platen roller 120 (platen) against which the print head 21 abuts via the ink ribbon 110 and the print tape 102 and which feeds the print tape 102 and the ink ribbon 110. Moreover, the tape cartridge 100 has a cartridge case 130 accommodating the tape roll 106, the ribbon roll 114, the take-up core 116 and the platen roller 120. In this way, the tape cartridge 100 in this embodiment has a so-called shell structure in which the outer shell is covered by the cartridge case 130.

Also, in the tape cartridge 100, an insertion opening 134 in which the print head 21 is inserted when the tape cartridge 100 is loaded in the tape printing device 1 is formed in the cartridge case 130. Also, the tape cartridge 100 has a tape outlet port 138 which is formed in the cartridge case 130 and through which the print tape 102 is sent out. The insertion opening 134 may be a through-hole or may be a pouch-like hole. Also, as will be described in detail later, the tape roll 106 is rotatably supported on a cylindrical core shaft 192 provided in a protruding manner on the inside of the cartridge case 130.

As the platen roller 120 and the take-up core 116 are driven by the above tape feed mechanism section 25, the print tape 102 is reeled off from the tape core 104, and the ink ribbon 110 is reeled off from the reel-off core 112. The print tape 102 and the ink ribbon 110, thus reeled off, travel in parallel at the part of the platen roller 120 and are used for printing by the print head 21. The reel-off end (printed part) of the print tape 102 where printing has been done is sent out toward the tape discharge port 17 from the tape outlet port 138. Meanwhile, the ink ribbon 110 travels around a circumferential wall part of the insertion opening 134 and is taken up on the take-up core 116. As the tape cartridge 100, a plurality of types with different thicknesses is prepared according to the tape widths of the print tape 102.

[Details of Tape Printing Device]

Figure 3:
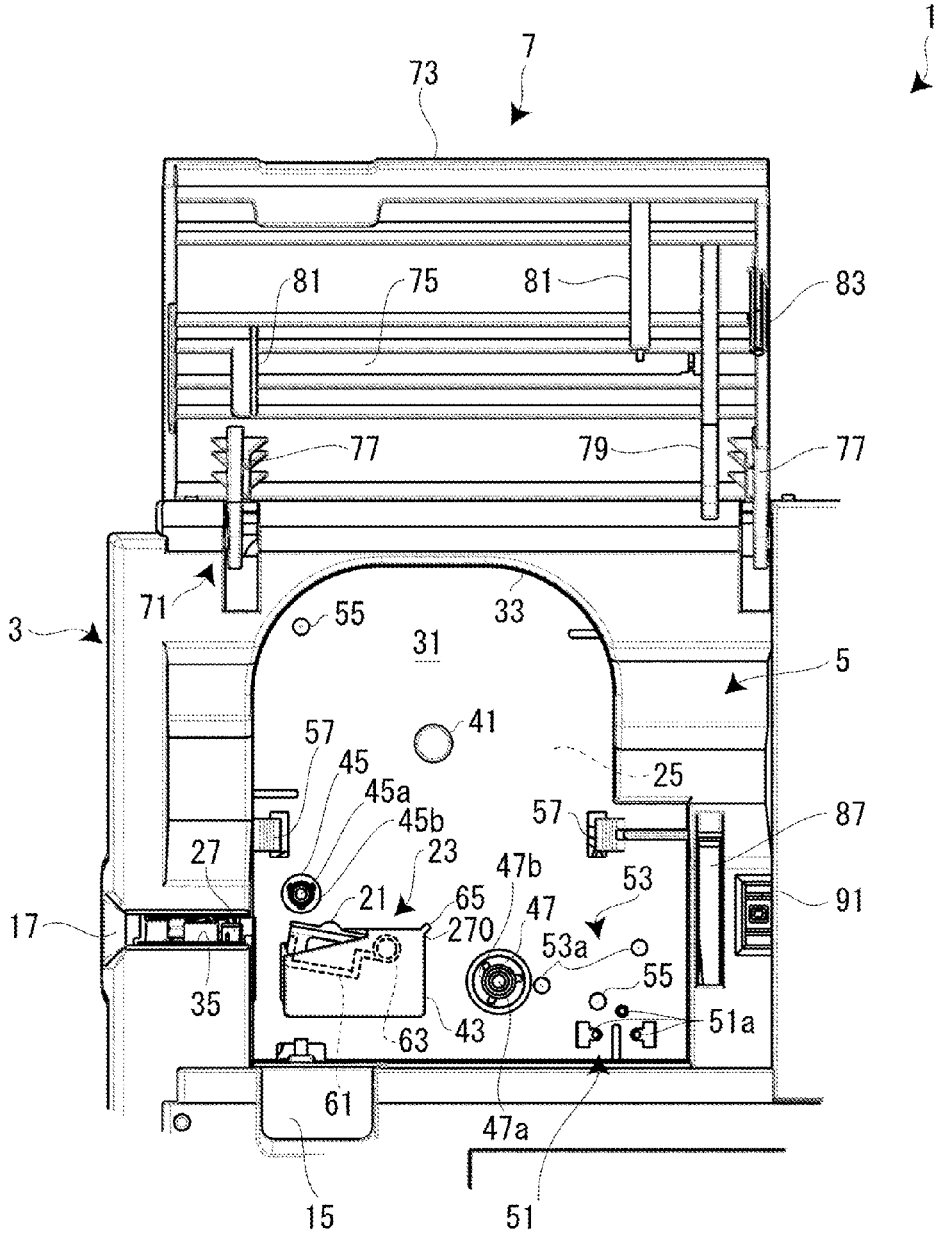
FIG. 3 is a plan view of a cartridge loading section.

As shown in FIG. 1 and FIG. 3, the cartridge loading section 5 is formed in a planar shape complementary to the planar shape of the tape cartridge 100 and is formed as a dent having a depth corresponding to the tape cartridge 100 with a maximum thickness, of the plurality of types of loadable tape cartridges 100. In this case, a loading base 31 forming a bottom plate part of the cartridge loading section 5, and a side plate part 33 are integrally formed (molded) of a resin or the like. A slit-like tape discharge path 35 is formed between the cartridge loading section 5 and the above tape discharge port 17, and the above tape cutting mechanism section 27 is arranged inside this part.

On the loading base 31 of the cartridge loading section 5, a positioning protrusion 41 with which the core shaft 192 is fitted and positioned, the print head 21 covered by a head cover 43, a platen drive shaft 45 which rotationally drives the platen roller 120, and a take-up drive shaft 47 which rotationally drives the take-up core 116 are provided upright. Also, on the loading base 31, a tape detection section 51 which detects the type (attribute information) of the print tape 102, and a core release section 53 which cancels the rotation stopper of the reel-off core 112 and the take-up core 116 are provided near the take-up drive shaft 47.

Moreover, a pair of small protrusions 55 is provided at diagonal positions on the loading base 31, and in addition, a pair of hook pieces 57 which hooks a middle part of the loaded tape cartridge 100 is provided. Then, in the space on the back of the loading base 31, the above tape feed mechanism section 25 made up of a motor and a gear train (neither being illustrated) or the like for rotating the platen drive shaft 45 and the take-up drive shaft 47 is arranged inside. The tape feed mechanism section 25 performs power branching via the gear train and thus causes the platen drive shaft 45 and the take-up drive shaft 47 to rotate synchronously.

The print mechanism section 23 has the print head 21 made up of a thermal head, and a head support frame 61 which supports the print head 21 and causes the print head 21 to swivel via a swivel support shaft 63. Also, the print mechanism section 23 has a head release mechanism (not illustrated) which causes the print head 21 to swivel between a printing position and a retreat position via the head support frame 61, and the head cover 43 covering the print head 21 (and the head support frame 61).

The head release mechanism is actuated, interlocked with the opening/closing of the above open/close cover 7, and causes the print head 21 to move (swivel) to the printing position, interlocked with the closing operation of the open/close cover 7. Also, the head release mechanism causes the print head 21 to move (swivel) to the retreat position, interlocked with the opening operation. The print head 21, having moved to the printing position, abuts against the platen roller 120 via the ink ribbon 110 and the print tape 102. The print head 21, having moved to the retreat position, is spaced apart from the platen roller 120. Thus, the print tape 102 and the ink ribbon 110 are prevented from interfering with the print head 21 at the time of loading or unloading the tape cartridge 100.

A plurality of heat generating elements is provided in the print head 21, and the plurality of heat generating elements is arrayed in the same direction as the axial direction of the platen roller 120. Then, printing is carried out by feeding the print tape 102 and the ink ribbon 110 and selectively driving the plurality of heat generating elements.

The head cover 43 is formed in a substantially rectangular shape, as viewed in a plan view, and is integrally formed (molded) with the above loading base 31 (cartridge loading section 5). Also, the head cover 43 vertically largely protrudes from the loading base 31, allows the print head 21 to swivel inside the head cover 43, and functions on its outside as a loading guide for the tape cartridge 100. As will be described in detail later, the head cover 43 further includes a main body-side abutting portion 65 provided in such a way as to protrude outward, on a corner 270 on the side of the above swivel support shaft 63.

The tape detection section 51 is made up of a plurality of microswitches 51*a*, is selectively engaged with a section to be detected 180 of the tape cartridge 100, described later, and detects the type including tape width, tape color, material and the like of the print tape 102. Then, on the basis of the result of the detection, the driving of the print head 21 and the tape feed mechanism section 25 is controlled. The core release section 53 is made up of two cancellation pins 53*a* for the reel-off core 112 and the take-up core 116. As will be described in detail later, rotation stopper hooks 206 (see FIG. 6) to be hooked on the reel-off core 112 and the take-up core 116, respectively, are provided in the cartridge case 130. As the tape cartridge 100 is loaded, the cancellation pins 53*a* are engaged with these rotation stopper hooks 206, cancelling the rotation stopper of the reel-off core 112 and the take-up core 116.

The platen drive shaft 45 has a fixed shaft 45*a* extending to be long enough to be inserted through the platen roller 120, and a spline-shaped movable shaft 45*b* rotatably axially supported at a proximal part of the fixed shaft 45*a*. The rotational power of the tape feed mechanism section 25 is transmitted to this movable shaft 45*b* and further transmitted from the movable shaft 45*b* to the platen roller 120. Similarly, the take-up drive shaft 47 has a fixed shaft 47*a* and a spline-shaped movable shaft 47*b* rotatably axially supported on the fixed shaft 47*a*. In this case, too, the rotational power of the tape feed mechanism section 25 is transmitted to the movable shaft 47*b* and further transmitted from the movable shaft 47*b* to the take-up core 116.

When the tape cartridge 100 is loaded in the cartridge loading section 5, the core shaft 192 (tape core 104) is engaged with the positioning protrusion 41, and the platen roller 120 is engaged with the platen drive shaft 45. Moreover, the take-up core 116 is engaged with the take-up drive shaft 47. Then, as the open/close cover 7 is closed, the print head 21 swivels and abuts against the platen roller 120 via the print tape 102 and the ink ribbon 110. Thus, the tape printing device 1 enters into a print standby state.

Figure 4:
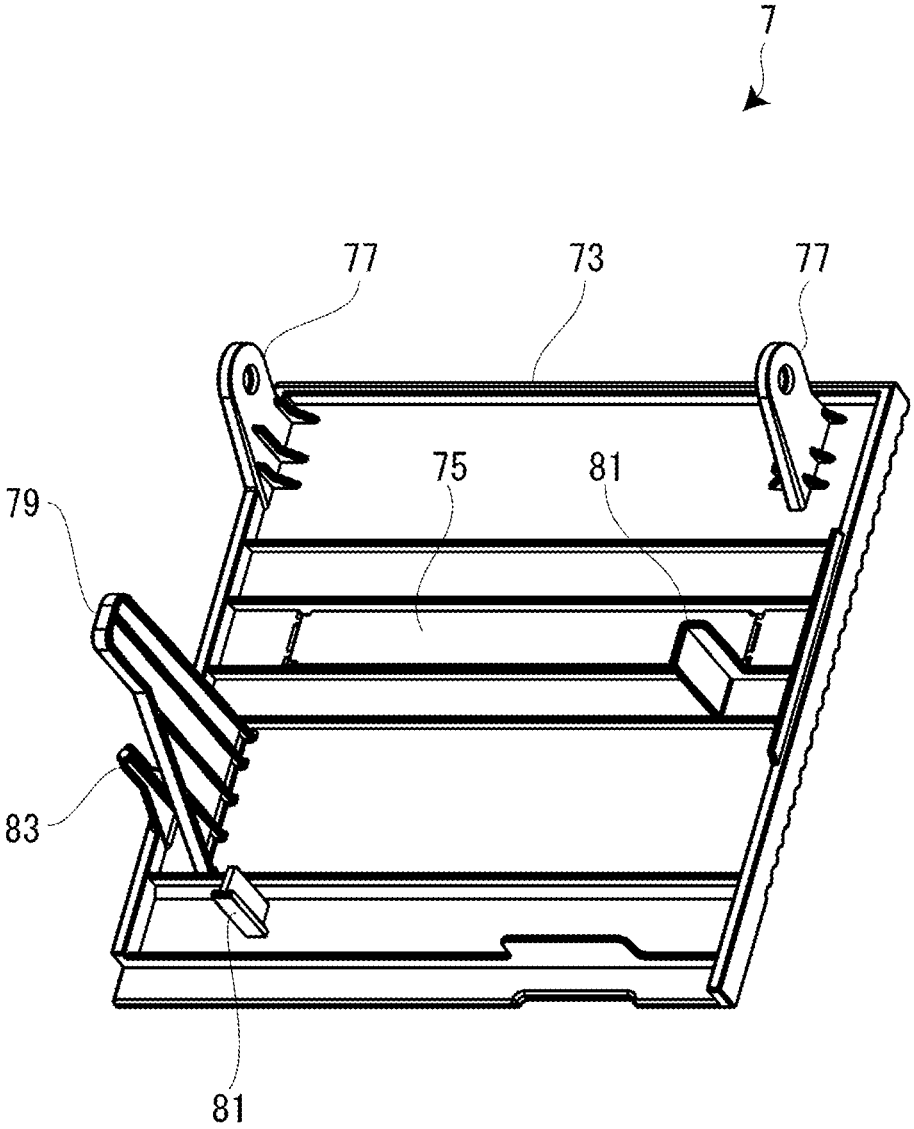
FIG. 4 is a perspective view of an open/close cover, as viewed from the back side.

As shown in FIG. 1 and FIG. 4, the open/close cover 7 is mounted on the device case 3 via a hinge portion 71 provided on the rear side, in such a way as to be able to swivel, that is, to be able to open/close. The open/close cover 7 includes an open/close cover main body 73 formed in a rectangular shape as viewed in a plan view, and a view window 75 provided at the center of the open/close cover main body 73. Also, the open/close cover 7 includes a pair of shaft support pieces 77 provided in a protruding manner on the back of the open/close cover main body 73 and axially supported on the hinge portion 71 in such away as to be able to swivel, and an actuation lever 79 which is provided in a protruding manner on the back of the open/close cover main body 73 and causes the print head 21 to swivel. Moreover, the open/close cover 7 includes two push-in protrusions 81 which are provided in a protruding manner on the back of the open/close cover main body 73 and push in the tape cartridge 100, and a press protrusion 83 which is provided in a protruding manner on the back of the open/close cover main body 73 and actuates (turns ON) a built-in cover closing detection switch (not illustrated).

The view window 75 is formed to be laterally long and made of a transparent resin (transparent to visible rays) as a separate member from the open/close cover main body 73. Through this view window 75, the tape cartridge 100 loaded in the cartridge loading section 5 can be visually confirmed (the type of the print tape 102 and the amount of tape left). Also, the pair of shaft support pieces 77, the actuation lever 79, the two push-in protrusions 81 and the press protrusion 83, and the open/close cover main body 73 are integrally formed (molded) of a resin.

The actuation lever 79 protrudes largely from the back of the open/close cover main body 73. With the closing of the open/close cover 7, the actuation lever 79 is inserted in a slit opening 87 provided to the lateral side of the cartridge loading section 5. The actuation lever 79 inserted in the slit opening 87 actuates the above head release mechanism and causes the print head 21 to swivel. Similarly, with the closing of the open/close cover 7, the press protrusion 83 is inserted in a rectangular opening 91 next to the slit opening 87 and actuates (for example, turns "ON") the cover closing detection switch.

One push-in protrusion 81 corresponds to a position near the platen roller 120 of the tape cartridge 100. The other push-in protrusion 81 corresponds to a position directly above the above tape detection section 51. As the open/close cover 7 is closed, the two push-in protrusions 81 push in the tape cartridge 100 so that the tape cartridge 100 sits on the loading base 31 of the cartridge loading section 5, and the push-in protrusions 81 also prevent the tape cartridge 100 from floating up.

[Details of Tape Cartridge]

Next, the tape cartridge 100 will be described in detail, referring to FIGS. 2A, 2B, 5A, 5B, and 6. In the description of the tape cartridge 100, taking FIGS. 2A and 2B as an example, the forward side in the loading direction, which is the top front side of the tape cartridge 100, is referred to as the "front side", and the rear side in the loading direction, which is the opposite side, is referred to as the "back side". Also, taking FIGS. 2A and 2B as an example, the lateral side on the left of the tape cartridge 100 is referred to as the "left lateral side", the lateral side on the right as the "right lateral side", the arcuate side on the top (forward side) as the "distal side", and the side on the bottom (rear side) as the "proximal side".

The tape cartridge 100 includes the cartridge case 130, and the tape roll 106, the ribbon roll 114, the take-up core 116 and the platen roller 120 accommodated therein, as described above. Also, the tape cartridge 100 has the insertion opening 134 formed in the cartridge case 130, the tape outlet port 138 formed on the left lateral side, near the platen roller 120, and an identification seal 141 (see FIG. 1) bonded over the front side, the left lateral side and the right lateral side of the part where the tape roll 106 is accommodated. The identification seal 141 shows the tape width, tape color, material and the like of the print tape 102 accommodated in the cartridge case 130, at the two parts of the front side and the left lateral side.

The cartridge case 130 forms the outer shell of the tape cartridge 100 (shell structure) and has an "L"-shaped appearance as viewed in a plan view, with the proximal side part on the right lateral side slightly protruding. In the front-back direction, the cartridge case 130 is formed by a lower case 150 which comes to the rear side when the tape cartridge is loaded in the cartridge loading section 5, and an upper case 152 which comes to the forward side. In the cartridge case 130 in this embodiment, the upper case 152 is formed by a molded member of a transparent resin, and the lower case 150 is formed by a molded member of an opaque resin.

The upper case 152 is integrally formed (molded) by a top wall portion 156 forming the front side of the cartridge case 130, and an upper circumferential wall portion 158 suspended on a circumferential edge part of the top wall portion 156. Meanwhile, the lower case 150 is integrally formed (molded) by a bottom wall portion 160 forming the back side of the cartridge case 130, a lower circumferential wall 162 provided upright on a circumferential edge part of the bottom wall portion 160, and an opening circumferential wall portion 164 provided upright on the bottom wall portion 160 so as to define the above insertion opening 134.

The insertion opening 134 defined by the opening circumferential wall portion 164 is the part in which the head cover 43 of the cartridge loading section 5 is inserted, and has a cartridge-side abutting portion 166 corresponding to the above main body-side abutting portion 65 provided on the head cover 43, as described below. As the tape cartridge 100 is loaded in the cartridge loading section 5, the cartridge-side abutting portion 166 of the tape cartridge 100 abuts against the main body-side abutting portion 65 of the head cover 43, and the tape cartridge 100 is thus positioned in the cartridge loading section 5 (described in detail later).

Figures 5A, 5B:
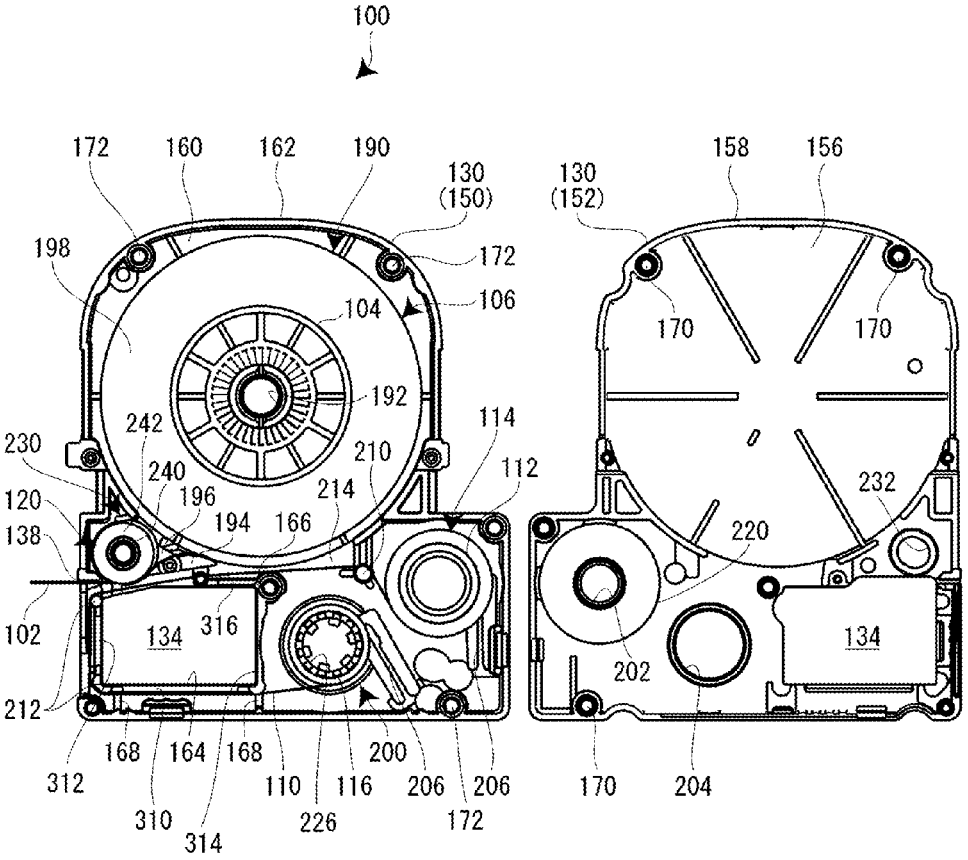
FIG. 5A is a plan view of an upper case and the tape cartridge in the state where the upper case is removed.
FIG. 5B is a back view of the upper case.

A plurality of joint pins 170 is provided at a proper interval on a lower end surface of the upper circumferential wall portion 158 of the upper case 152, whereas a plurality of joint holes 172 corresponding to the plurality of joint pins 170 is provided in the lower circumferential wall 162 of the lower case 150 (see FIGS. 5A and 5B). After components such as the tape roll 106 and the ribbon roll 114 are set in the lower case 150, the upper case 152 is joined thereto in such a way that the plurality of joint pins 170 is press-fitted in the plurality of joint holes 172, thus assembling the tape cartridge 100. Each joint hole 172 is a through-hole in consideration of easiness of molding.

Figure 2A:
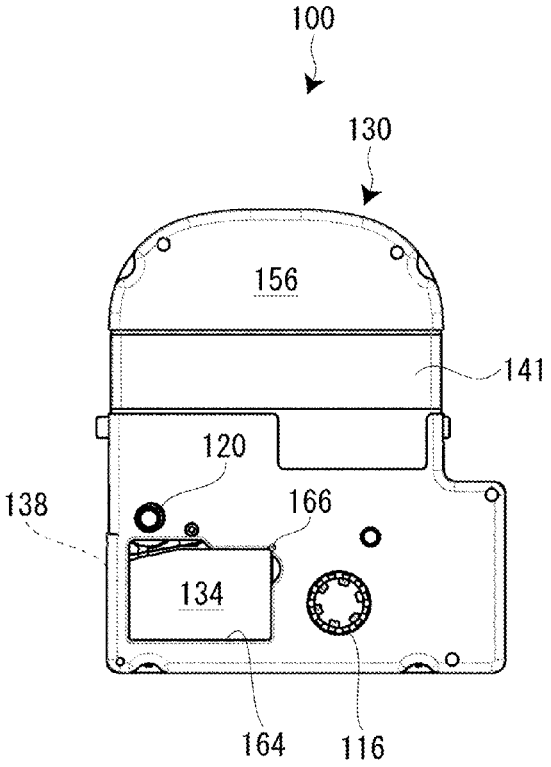
FIG. 2A is a plan view and FIG. 2B is a side view of the tape cartridge according to the embodiment.
Figure 2B:
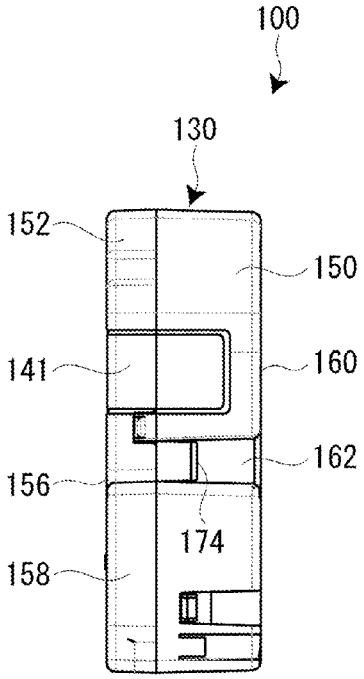
Figure 6:
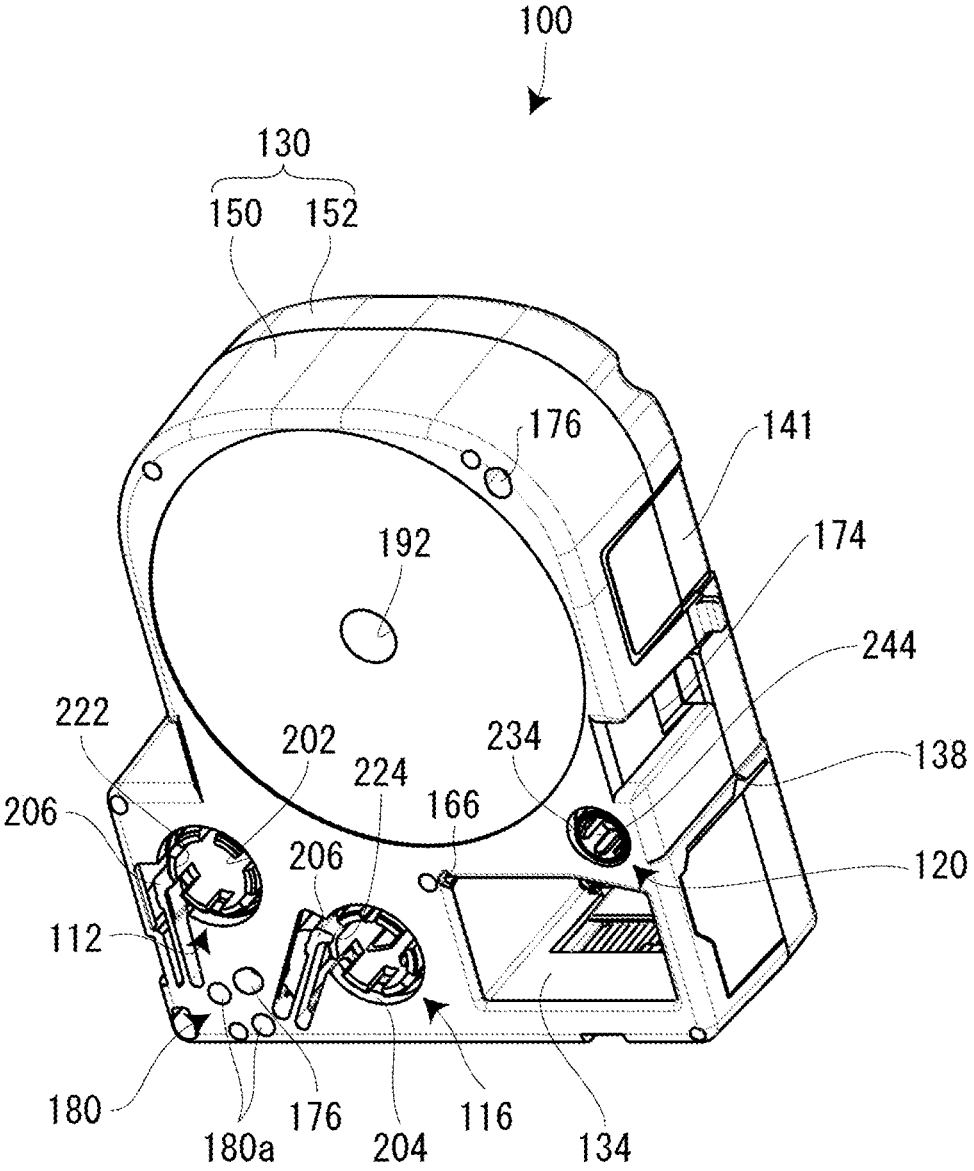
FIG. 6 is a perspective view of the tape cartridge, as viewed from the back side.

Meanwhile, a pair of hook receiving portions 174 to be hooked on the above pair of hook pieces 57 is provided on the left lateral side and the right lateral side of the lower case 150 (see FIGS. 2A and 2B and FIG. 6). As the pair of hook pieces 57 on the side of the cartridge loading section 5 is hooked on the pair of hook receiving portions 174 of the loaded tape cartridge 100, the tape cartridge 100 is prevented from floating up. Also, fitting small holes 176 in which the above pair of small protrusions 55 is fitted with a certain margin are provided on the back side of the lower case 150 (see FIG. 6). As the pair of small protrusions 55 on the side of the cartridge loading section 5 is fitted in the pair of fitting small holes 176 in the loaded tape cartridge 100, the tape cartridge 100 is easily positioned on the loading base 31.

Moreover, on the back side of the lower case 150, the section to be detected 180 corresponding to the above tape detection section 51 is provided at a position in the left corner on the proximal side (right corner as viewed from the front side) (see FIG. 6). The section to be detected 180 is formed by a section corresponding to the plurality of microswitches 51*a* of the tape detection section 51, and a plurality of bit patterns is acquired according to the presence/absence of receiving holes 180*a* provided in this section. That is, the bit patterns correspond to the type of the above print tape 102.

As shown in FIGS. 5A and 5B, a broad tape accommodation area 190 in which the tape roll 106 is accommodated is formed in a space on the upper side (distal side) in the cartridge case 130. At the center of the tape accommodation area 190, the core shaft 192 integrally formed (molded) with the lower case 150 is provided upright. The core shaft 192 is cylindrically formed, and on its outer circumferential surface, the tape roll 106 (tape core 104) is rotatably axially supported. Also, in the tape accommodation area 190, near the platen roller 120, a tape guide 194 which guides the reeled-off print tape 102 to the platen roller 120 is provided upright integrally with the lower case 150.

That is, inside the cartridge case 130, a tape feed path 196 is formed, starting at the tape roll 106 and reaching the tape outlet port 138 via the tape guide 194 and the platen roller 120. The print tape 102 reeled off from the tape roll 106 is guided to the platen roller 120 via the tape guide 194, used for printing there, and further guided from the platen roller 120 to the tape outlet port 138.

The tape roll 106 has the print tape 102 and the tape core 104, and also has two films 198 bonded to both end surfaces of the print tape 102 in a roll shape. The two films 198 prevent the print tape 102 wound on the tape core 104 from unwinding. Also, a reverse rotation stopper mechanism is incorporated in the tape core 104, though not illustrated. When carrying the tape cartridge 100, reverse rotation of the print tape 102 is prevented by this reverse rotation stopper mechanism. Meanwhile, when the tape cartridge 100 is loaded in the cartridge loading section 5 of the tape printing device 1, the reverse rotation stopper by the reverse rotation stopper mechanism is cancelled by the above positioning protrusion 41, thus enabling the print tape 102 to be fed.

On the right side of the proximal part in the cartridge case 130, a ribbon accommodation area 200 is formed next to the insertion opening 134. To the right in the ribbon accommodation area 200, a reel-off side bearing portion 202 which rotatably supports the ribbon roll 114 (reel-off core 112), and to the left, a take-up side bearing portion 204 which rotatably supports the take-up core 116, are formed integrally with the cartridge case 130. That is, the reel-off side bearing portion 202 and the take-up side bearing portion 204 are formed each in the upper case 152 and the lower case 150.

In cut-out parts of the reel-off side bearing portion 202 and the take-up side bearing portion 204 formed in the lower case 150, rotation stopper hooks 206 having their distal parts facing the reel-off side bearing portion 202 and the take-up side bearing portion 204 are integrally formed, respectively. Then, one rotation stopper hook 206 is engaged with the reel-off core 112 and the other rotation stopper hook 206 is engaged with the take-up core 116, each in a rotation stopping state.

In the ribbon accommodation area 200, near the reel-off side bearing portion 202, a first ribbon guide 210 which guides the reeled-off ink ribbon 110 to the platen roller 120 is provided upright integrally with the lower case 150. Also, on the outer circumferential side of the above opening circumferential wall portion 164, a plurality of second ribbon guides 212 which guides the circular movement of the ink ribbon 110 is integrally formed.

That is, inside the cartridge case 130, a ribbon feed path 214 is formed, starting at the ribbon roll 114 and reaching the take-up core 116 via the first ribbon guide 210, the platen roller 120 and the plurality of second ribbon guides 212. The ink ribbon 110 reeled off from the ribbon roll 114 is guided to the platen roller 120 via the first ribbon guide 210, is used for printing there, then further travels around the opening circumferential wall portion 164 (the plurality of second ribbon guides 212) from the platen roller 120, and is taken up on the take-up core 116.

Figure 7A:
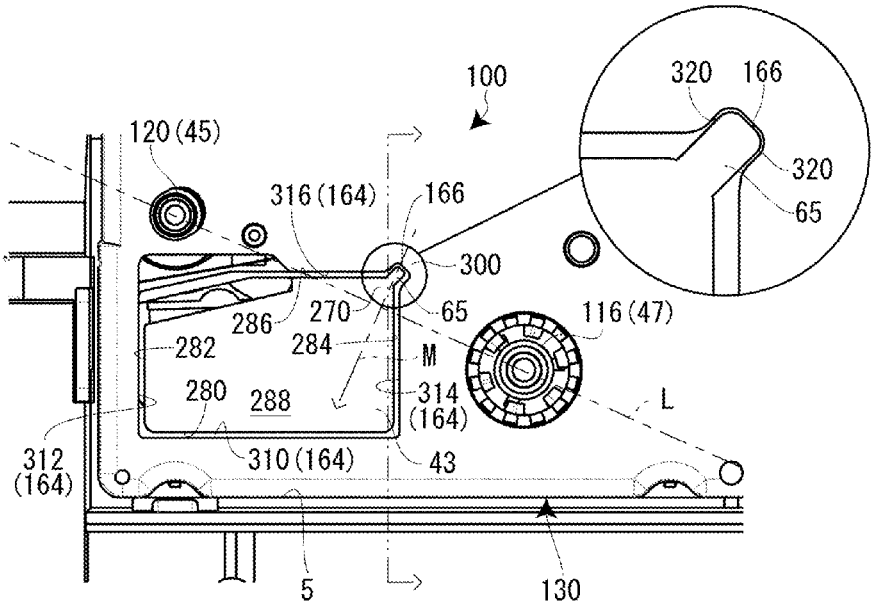
FIG. 7A is an enlarged plan view and FIG. 7B is an enlarged cross-sectional view of the vicinities of the main body-side abutting portion in the state where a tape cartridge is loaded in a tape printing device according to a first embodiment.

In the ribbon feed path 214 around the opening circumferential wall portion 164, a plurality of rib-like regulating portions 168 is provided in order to regulate downward misalignment of the ink ribbon 110 (see FIG. 7A). The plurality of rib-like regulating portions 168 is provided, each in the shape of a rib, at the position of the first ribbon guide 210, the position of the second ribbon guide 212, the position of a corner of the opening circumferential wall portion 164 and the like, on the bottom wall portion 160 of the lower case 150.

The ribbon roll 114 has the ink ribbon 110 and the reel-off core 112, and also has a ring-shaped leaf spring 220 which applies a braking load to the reel-off core 112 (see FIG. 5B). The leaf spring 220 is formed in a wave shape in the circumferential direction and is provided between the top wall portion 156 of the upper case 152 and the reel-off core 112 in the axial direction. That is, a rotation braking load is applied to the reel-off core 112 by the spring force of this leaf spring 220. Thus, a back tension is applied to the ink ribbon 110 being reeled off by the take-up core 116, preventing the ink ribbon 110 from loosening.

The reel-off core 112 is cylindrically formed, and at its end on the side of the lower case 150, a plurality of cut-outs 222 is formed in the circumferential direction (see FIG. 6). Then, the above rotation stopper hooks 206 are to be engaged with and disengaged from the plurality of cut-outs 222. While the reel-off side bearing portion 202 on the side of the lower case 150 supporting the reel-off core 112 is formed as a circular opening, the reel-off side bearing portion 202 on the side of the upper case 152 is formed as a cylindrical protruding part. Then, the above leaf spring 220 is mounted on this protruding part (see FIG. 5B for each of these parts).

Similarly, the take-up core 116 is cylindrically formed, and at its end on the side of the lower case 150, a plurality of cut-outs 224 is formed in the circumferential direction. Then, the above rotation stopper hooks 206 are engaged with and disengaged from the plurality of cut-outs 224. Also, a spline groove 226 is formed on the inner circumferential surface of the take-up core 116 and spline-engaged with the above take-up drive shaft 47. Thus, the rotational force of the take-up drive shaft 47 is transmitted to the take-up core 116, and the ink ribbon 110 is taken up.

On the left side of the proximal part in the cartridge case 130, a platen accommodation area 230 is formed next to the insertion opening 134. In the center of the platen accommodation area 230, a lower bearing portion 234 (see FIG. 6) in the form of an elliptic opening formed in the lower case 150, and an upper bearing portion 232 (see FIG. 5B) in the form of an elliptic opening formed in the upper case 152 are provided. Then, on the upper bearing portion 232 and the lower bearing portion 234, the platen roller 120 is supported in a rotatable and slightly movable (laterally movable) manner. That is, the platen roller 120 supported on the elliptic upper bearing portion 232 and lower bearing portion 234 is configured to be movable (finely movable) between a home position where the platen roller 120 is engaged with the platen drive shaft 45 and a nipping position where the platen roller 120 abuts against the tape guide 194 with the print tape 102 nipped between them.

Incidentally, this tape cartridge 100 is carried in the state where the reel-off end of the print tape 102 is slightly protruding outward from the tape outlet port 138 (see FIG. 1). In this case, if a push-in force or pull-in force acts on the reel-off end of the print tape 102 by mistake, the platen roller 120, which is drawn by this, moves to the above nipping position. Thus, the reel-off end of the print tape 102 is prevented from being pulled into the cartridge case 130 from the tape outlet port 138.

The platen roller 120 has a cylindrical roller base 240 and a rubber roller 242 mounted on the outer circumferential surface of the roller base 240. The rubber roller 242 has a length corresponding to the print head 21 in the axial direction. The print head 21, having moved to the printing position, abuts against this rubber roller 242 with the print tape 102 and the ink ribbon 110 nipped between them. Also, a spline groove 244 is formed on the inner circumferential surface of the roller base 240 and spline-engaged with the above platen drive shaft 45. Thus, the rotational force of the platen drive shaft 45 is transmitted to the platen roller 120, and the print tape 102 (and the ink ribbon 110) is fed for printing.

By the way, in the tape cartridge 100 in this embodiment, a rotational force is inputted to the platen roller 120 from the platen drive shaft 45, and a rotational force is inputted to the take-up core 116 from the take-up drive shaft 47. Therefore, the rotational force acts on the cartridge case 130 as a moment of rotation via the friction at the bearing part of the platen roller 120, and the rotational force also acts on the cartridge case 130 as a moment of rotation via the friction at the bearing part of the take-up core 116. Since the two moments of rotation act in opposite directions to each other and a resultant force M of these has no vector components which cancel each other on an imaginary line L connecting the platen roller 120 and the take-up core 116, the resultant force acts to the maximum in a direction intersecting with the imaginary line L (see FIG. 7A). Thus, in this embodiment, the above main body-side abutting portion 65 is provided on the head cover 43, and the above cartridge-side abutting portion 166 is provided on the tape cartridge 100, thereby resisting the above resultant force M.

[Structure Around Main Body-Side Abutting Portion First Embodiment]

Next, referring to FIG. 7A to FIG. 9, the structure of the main body-side abutting portion 65 of the head cover 43 according to the first embodiment will be described in detail along with the structure of the cartridge-side abutting portion 166 of the tape cartridge 100. Also, the print head unit in the claims is formed by the print head 21 covered by the head cover 43, and the head support frame 61 supporting this.

As shown in the enlarged views of FIGS. 7A and 7B and FIGS. 8A and 8B, the head cover 43 provided upright on the loading base 31 of the cartridge loading section 5 is provided with the main body-side abutting portion 65 on the corner 270 on the side of the above swivel support shaft 63. The head cover 43 has a rear cover sidewall 280 (third cover sidewall) covering the back side of the print head 21, and a left cover sidewall 282 (fourth cover sidewall) and a right cover sidewall 284 (second cover sidewall) extending at right angles from both outer ends of the rear cover sidewall 280, respectively. Also, the head cover 43 has a front cover sidewall 286 (first cover sidewall) covering the front half part of the print head 21, and a cover top wall 288 covering the print head 21 from above. Also, these are integrally formed.

The main body-side abutting portion 65 is provided in a protruding (projecting) manner on the corner 270, where the right cover sidewall 284 and the front cover sidewall 286 intersect with each other (meet each other). Specifically, the main body-side abutting portion 65 is formed with a rectangular cross section and provided in a protruding manner at the apex part of the above corner 270. Also, the main body-side abutting portion 65 extends to reach the same height as the head cover 43 from the loading base 31. As described above, the head cover 43 and the loading base 31 are integrally formed (molded), and the main body-side abutting portion 65, too, is formed (molded) integrally with these.

Also, as shown in FIG. 7A, the main body-side abutting portion 65 is arranged near an imaginary line L connecting the platen drive shaft 45 and the take-up drive shaft 47. As described above, the force acting on the tape cartridge 100 on the basis of the rotations of the platen drive shaft 45 and the take-up drive shaft 47 acts to the maximum in a direction intersecting the imaginary line L connecting the platen roller 120 and the take-up core 116. Thus, in order to resist this force, the main body-side abutting portion 65 is provided at a part of the head cover 43.

Figure 7B:
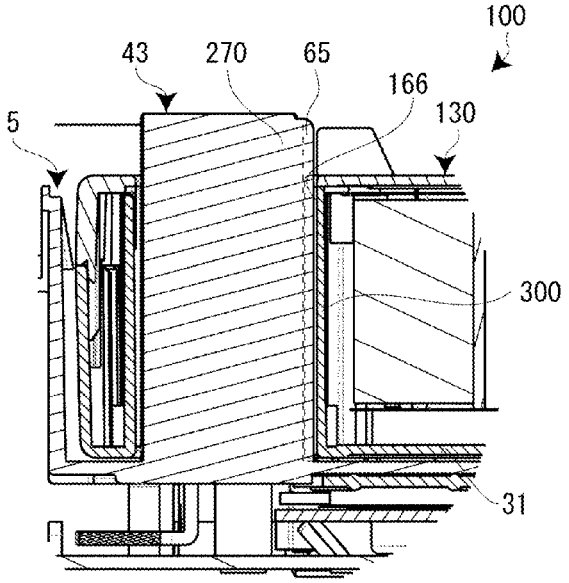
Figure 8A:
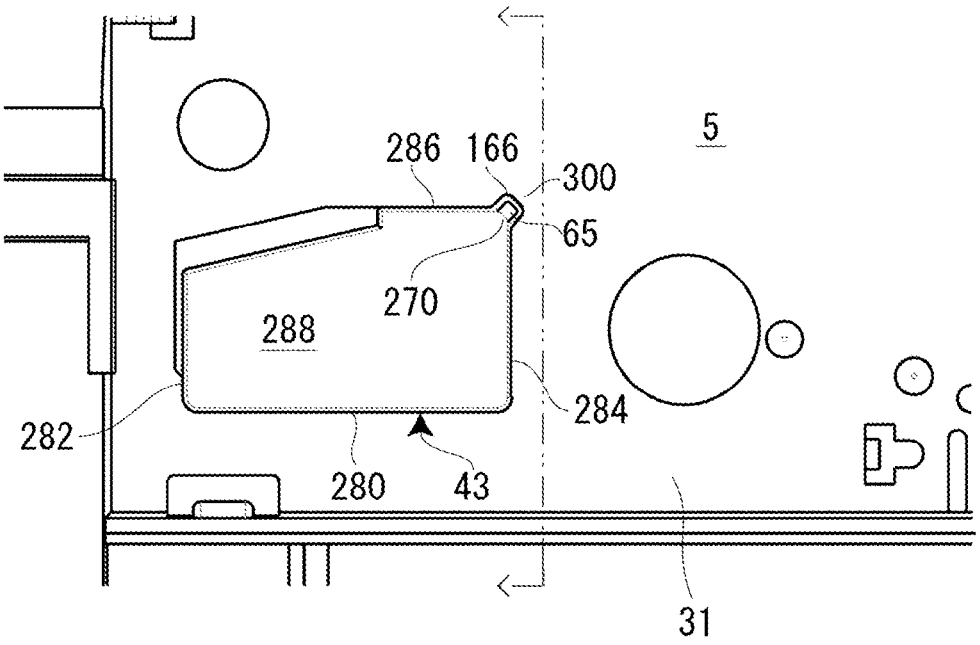
FIG. 8A is an enlarged plan view and FIG. 8B is an enlarged side view of the vicinities of a head cover in a cartridge loading section.
Figure 8B:
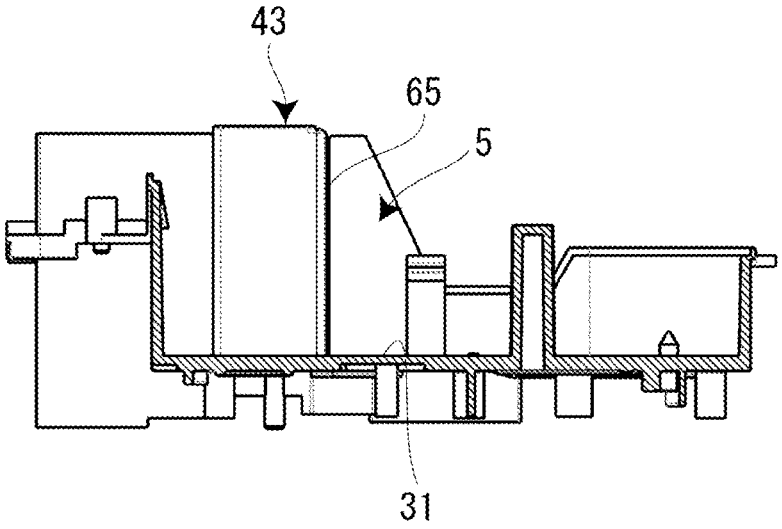
Figure 9:
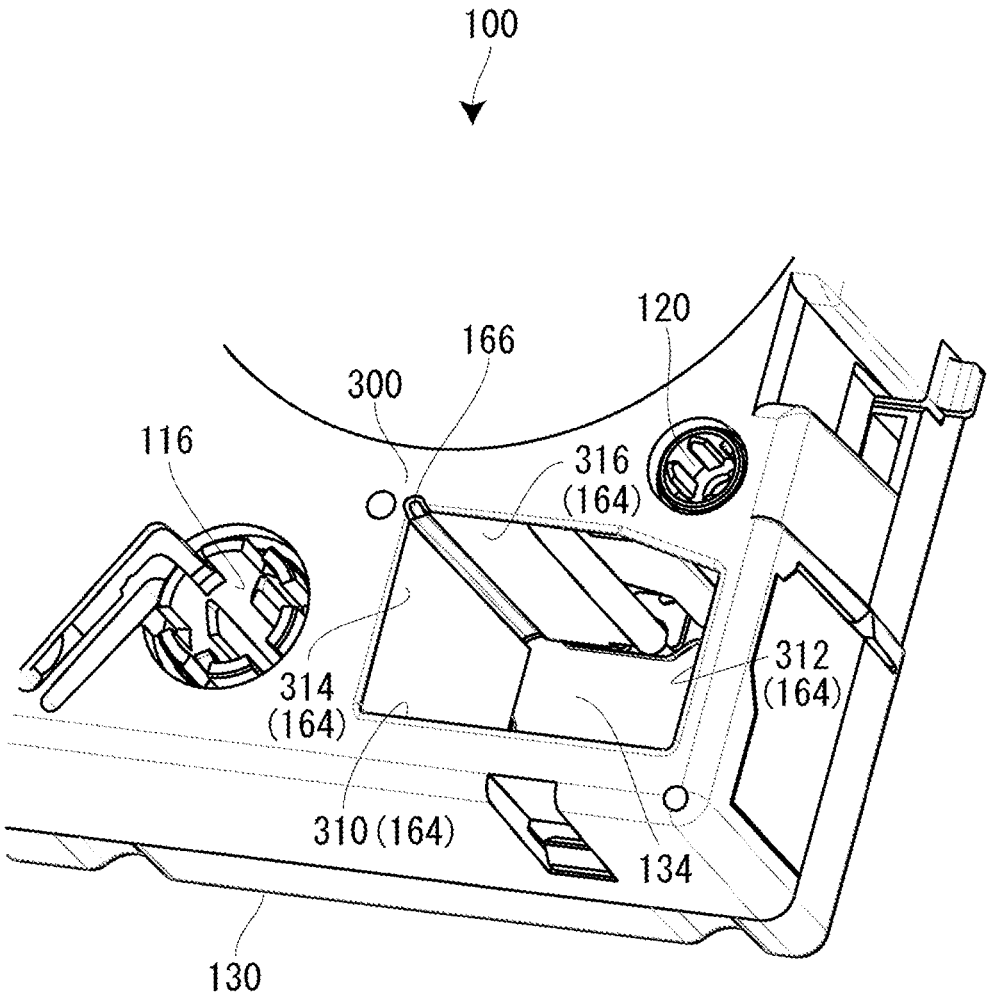
FIG. 9 is an enlarged perspective view of the vicinities of a cartridge-side abutting portion of the tape cartridge.

As shown in the enlarged views of FIGS. 7A and 7B and FIG. 9, the cartridge-side abutting portion 166 of the tape cartridge 100, which receives the main body-side abutting portion 65, is formed in a corner 300 corresponding to the above corner 270, of the opening circumferential wall portion 164 defining the insertion opening 134. Corresponding to the main body-side abutting portion 65, this cartridge-side abutting portion 166 is situated near the imaginary line L connecting the platen roller 120 and the take-up core 116 (see FIG. 7A).

The opening circumferential wall portion 164 has a rear opening inner wall 310 corresponding to the rear cover sidewall 280, and a left opening inner wall 312 corresponding to the left cover sidewall 282. Also, the opening circumferential wall portion 164 has a right opening inner wall 314 corresponding to the right cover sidewall 284, and a front opening inner wall 316 corresponding to the front cover sidewall 286. Then, the rear cover sidewall 280 and the rear opening inner wall 310 face each other with a space between them. Similarly, the left cover sidewall 282 and the left opening inner wall 312, the right cover sidewall 284 and the right opening inner wall 314, and the front cover sidewall 286 and the front opening inner wall 316 face each other with a space between them.

The cartridge-side abutting portion 166 is provided in a recessed manner in the corner 300, where the right opening inner wall 314 and the front opening inner wall 316 intersect with each other. In this case, the cartridge-side abutting portion 166 is formed with a rectangular cross section that is a complementary shape to the main body-side abutting portion 65 with a rectangular cross section. Also, corresponding to the main body-side abutting portion 65, the cartridge-side abutting portion 166 is formed continuously from the front side to the back side of the cartridge case 130. Then, the cartridge-side abutting portion 166 abuts against and is fitted with the main body-side abutting portion 65 in a direction intersecting with the imaginary line L connecting the platen roller 120 and the take-up core 116. Although these parts are not abutting against each other in the illustration, when a moment of rotation acts and the tape cartridge 100 moves by the amount of tolerance, these abutting portions abut against each other, thus regulating the movement of the tape cartridge 100.

The cartridge-side abutting portion 166 has two sidewall surfaces 320 parallel to each other, and these two sidewall surfaces 320 contact the lateral sides of the main body-side abutting portion 65. Thus, the cartridge-side abutting portion 166 (cartridge case 130) is positioned in the direction of the above imaginary line L (direction orthogonal to the protruding direction) by the main body-side abutting portion 65. Also, it is preferable that each of these two sidewall surfaces 320 has a tilted surface so as to widen out toward the side of the loading base 31. With this, the tilted surfaces function as a guide when loading the tape cartridge 100, and the cartridge case 130 can be accurately positioned in the direction of the imaginary line L.

In the first embodiment as described above, as the tape cartridge 100 is loaded in the cartridge loading section 5, the cartridge-side abutting portion 166 of the tape cartridge 100 is fitted with and abuts against the main body-side abutting portion 65 of the head cover 43. Since the cartridge-side abutting portion 166 exists on the imaginary line L connecting the platen roller 120 and the take-up core 116 (including its vicinity, as clear from FIGS. 7A and 7B), the rotational forces (moments of rotation) originating from the drive forces of the platen drive shaft 45 and the take-up drive shaft 47 have almost no vector components in the direction of cancelling each other and result in a superimposed force (combined force). Therefore, even when the rotational forces (moments of rotation) of the platen drive shaft 45 and the take-up drive shaft 47 act on the tape cartridge 100, the main body-side abutting portion 65 and the cartridge-side abutting portion 166 abut against each other with the above superimposed force and therefore misalignment of the tape cartridge 100 is restrained. Thus, a reduction in the print quality due to the misalignment of the tape cartridge 100 can be prevented.

While the main body-side abutting portion 65 is formed to reach substantially the same height as the head cover 43 in the first embodiment, the main body-side abutting portion 65 may be formed to be shorter (lower). Similarly, the cartridge-side abutting portion 166 may be formed to be shorter. Also, as described above, as the tape cartridge 100, there are tape cartridges with a plurality of thicknesses corresponding to the plurality of widths of the print tape 102. In the case of a tape cartridge with a large thickness, the insertion opening 34 in which the print head 21 (head cover 43) is inserted need not necessarily be a through-hole and may be a pouch-like hole with a ceiling as long as it can accommodate print head 21. In such a case, the cartridge-side abutting portion 166 may be provided with a length within the range of the depth of the pouch of this pouch-like hole.

[Structure Around Main Body-Side Abutting Portion: Second Embodiment]

Next, referring to FIG. 10, the structure of the main body-side abutting portion 65 of the head cover 43 according to the second embodiment will be described in detail along with the structure of the cartridge-side abutting portion 166 of the tape cartridge 100. Also, in the second embodiment, different parts from the first embodiment will be mainly described.

Figure 10:
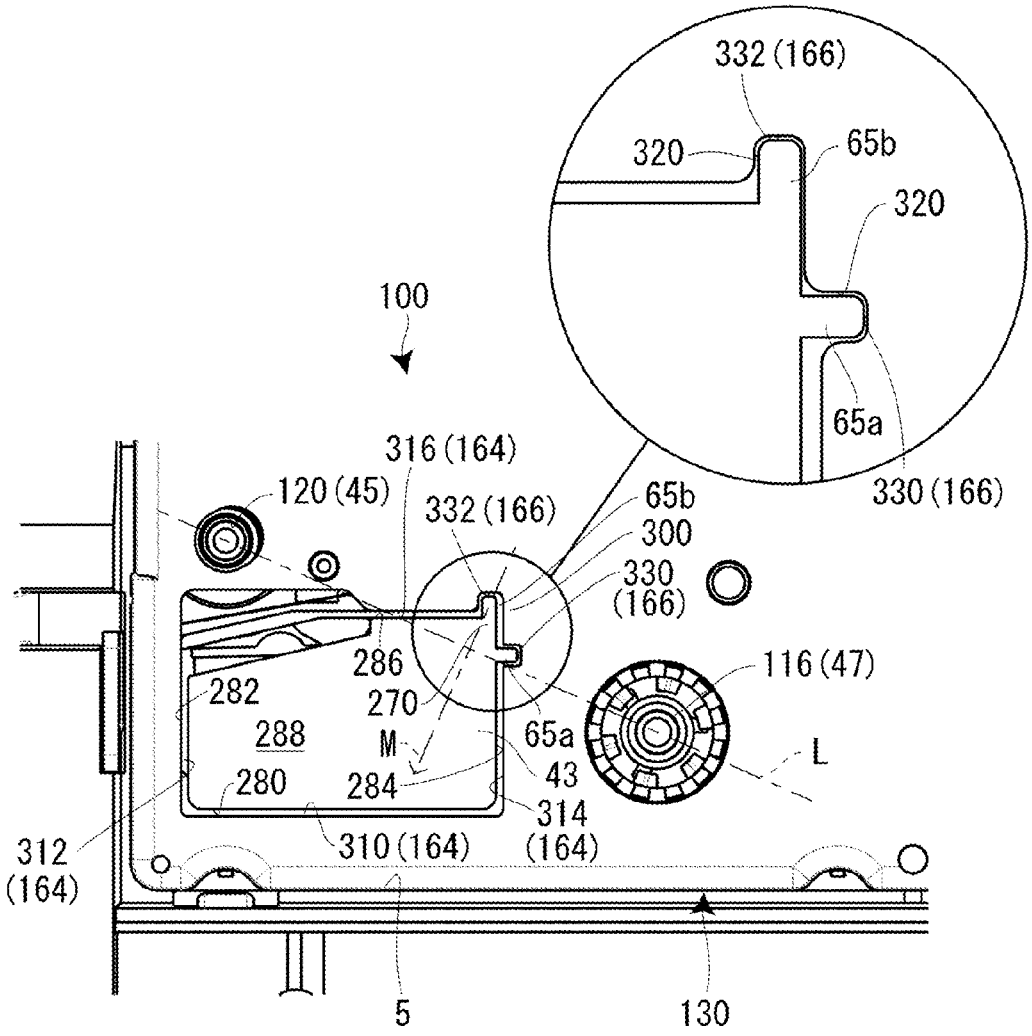
FIG. 10 is an enlarged plan view of the vicinities of a main body-side abutting portion in the state where a tape cartridge is loaded in a tape printing device according to a second embodiment.

As shown in FIG. 10, in the second embodiment, too, the main body-side abutting portion 65 is provided in a protruding (projecting) manner on the corner 270, where the right cover sidewall 284 and the front cover sidewall 286 intersect with each other, of the head cover 43. Specifically, the main body-side abutting portion 65 has a first abutting protrusion 65*a* with a rectangular cross-sectional shape provided in a projecting manner on the right cover sidewall 284, and a second abutting protrusion 65*b* with a rectangular cross-sectional shape provided in a projecting manner on the front cover sidewall 286, near the apex part of the corner 270. Also, the first abutting protrusion 65*a* and the second abutting protrusion 65*b* both extend to substantially the same height as the head cover 43 from the loading base 31. Variations of this height relation are similar to those in the first embodiment.

Meanwhile, the cartridge-side abutting portion 166, too, is provided in a recessed manner in the corner 300, where the right opening inner wall 314 and the front opening inner wall 316 intersect with each other, of the opening circumferential wall portion 164. Specifically, the cartridge-side abutting portion 166 has a first abutting recess 330 provided in a recessed manner in the right opening inner wall 314, corresponding to the above first abutting protrusion 65*a*. Also, the cartridge-side abutting portion 166 has a second abutting recess 332 provided in a recessed manner in the front opening inner wall 316, corresponding to the above second abutting protrusion 65*b*. In this case, too, the first abutting recess 330 is formed with a rectangular cross section that is a complementary shape to the first abutting protrusion 65*a*, and the second abutting recess 332 is formed with a rectangular cross section that is a complementary shape to the second abutting protrusion 65*b*.

Also, each of the first abutting recess 330 and the second abutting recess 332 is formed continuously from the front side to the back side of the cartridge case 130. Then, in this case, too, the first abutting recess 330 and the second abutting recess 332 have two sidewall surfaces 320 parallel to each other, and these two sidewall surfaces 320 contact the lateral sides of the first abutting protrusion 65*a* and the second abutting protrusion 65*b* corresponding thereto. Thus, the cartridge case 130 is positioned in the forward-rear and left-right directions.

In the second embodiment as described above, the tape cartridge 100 is loaded in the cartridge loading section 5. Then, the first abutting recess 330 and the second abutting recess 332 (cartridge-side abutting portion 166) of the tape cartridge 100 are respectively fitted with and abut against the first abutting protrusion 65*a* and the second abutting protrusion 65*b* (main body-side abutting portion 65) of the head cover 43. Therefore, even when the rotational forces (moments of rotation) of the platen drive shaft 45 and the take-up drive shaft 47 act on the tape cartridge 100, the tape cartridge 100 does not become misaligned.

[Structure Around Main Body-Side Abutting Portion: Third Embodiment]

Next, referring to FIG. 11, the structure of the main body-side abutting portion 65 of the head cover 43 according to the third embodiment will be described in detail along with the structure of the cartridge-side abutting portion 166 of the tape cartridge 100. Also, in the third embodiment, different parts from the first embodiment will be mainly described.

Figure 11:
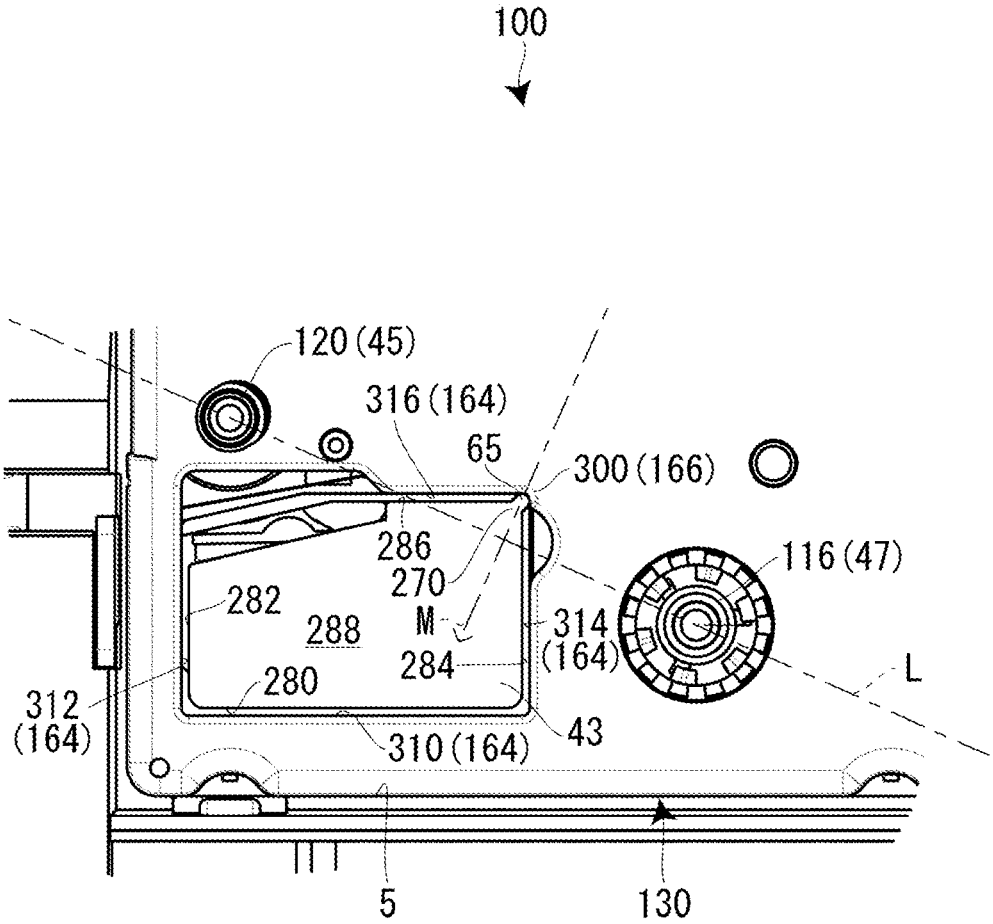
FIG. 11 is an enlarged plan view of the vicinities of a main body-side abutting portion in the state where a tape cartridge is loaded in a tape printing device according to a third embodiment.

As shown in FIG. 11, in this embodiment, the main body-side abutting portion 65 of the head cover 43 is formed (provided in a protruding manner) to be shorter than the main body-side abutting portion 65 in the first embodiment. Variations of this height relation are similar to those in the first embodiment.

As described above, a spacing is provided between the right cover sidewall 284 and the right opening inner wall 314, and a spacing is provided between the front cover sidewall 286 and the front opening inner wall 316 as well. Therefore, a spacing is formed between the corner 270 between these and the corner 300 between these.

The main body-side abutting portion 65 in this embodiment is provided in a protruding manner on the head cover 43, with a protruding dimension corresponding to the spacing between the corner 270 and the corner 300. Meanwhile, an inside corner part of the corner 300, where the right opening inner wall 314 and the front opening inner wall 316 intersect with each other, abuts against the main body-side abutting portion 65. That is, the cartridge-side abutting portion 166 in the third embodiment is formed by the inside corner part of the corner 300. In other words, the inside corner part of the corner 300 also serves as the cartridge-side abutting portion 166. In this case, the inside corner part of the corner 300 is arcuately formed due to the molding requirements, and the distal end of the main body-side abutting portion 65 corresponding to this is arcuately formed as well (in a complementary arcuate shape).

In the third embodiment as described above, as the tape cartridge 100 is loaded in the cartridge loading section 5, the corner 300 (cartridge-side abutting portion 166) of the tape cartridge 100 abuts against the main body-side abutting portion 65 of the head cover 43. Therefore, even when the rotational forces (moments of rotation) of the platen drive shaft 45 and the take-up drive shaft 47 act on the tape cartridge 100, the tape cartridge 100 does not become misaligned.

In each of the above embodiments, the main body-side abutting portion 65 is provided on or near the corner 270, and the cartridge-side abutting portion 166 is provided in or near the corner 300. However, these positions need not necessarily be employed and the advantageous effects of the invention can be achieved by situating the cartridge-side abutting portion 166 on the imaginary line L (including its vicinity) connecting the platen roller 120 and the take-up core 116 shown in FIGS. 7A and 7B. Also, the cartridge-side abutting portion 166 is illustrated as a recessed part or corner part. However, such forms need not necessarily be employed. For example, the cartridge-side abutting portion 166 may be simply a part of the wall opposite the main body-side abutting portion 65, of the wall of the opening circumferential portion 164, as long as the cartridge-side abutting portion 166 is situated on the imaginary line L (including its vicinity) connecting the platen roller 120 and the take-up core 116 and can receive the force from the main body-side abutting portion 65.

[Structure Around Main Body-Side Abutting Portion: Fourth Embodiment]

Next, referring to FIG. 12A to FIG. 14, the structure around the main body-side abutting portion 65 of the head cover 43 according to the fourth embodiment will be described. In this embodiment, a structure for guiding the loading of the tape cartridge 100 is added to the structure around the head cover 43 in the above first to third embodiments. Hereinafter, a configuration in which this guide structure is added to the head cover 43 in the first embodiment will be described.

As shown in the enlarged views of FIGS. 12A and 12B and FIGS. 13A and 13B, the head cover 43 provided upright on the loading base 31 of the cartridge loading section 5 is provided with guide protrusions 67 at three positions, each protruding outward. As the tape cartridge 100 is loaded in the cartridge loading section 5, the three guide protrusions 67 of the head cover 43 are fitted respectively with three guide recesses 169 of the tape cartridge 100, described later, and the tape cartridge 100 is positioned in the cartridge loading section 5.

The three guide protrusions 67 include a rear guide protrusion 400 provided in a protruding manner on the outer surface of the rear cover sidewall 280, a left guide protrusion 402 provided in a protruding manner on the outer surface of the left cover sidewall 282, and a right guide protrusions 404 provided in a protruding manner on the outer surface of the right cover sidewall 284. The rear guide protrusion 400 is arranged at a middle position in the direction of extension of the rear cover sidewall 280 and formed in a rectangular cross-sectional shape. The left guide protrusion 402 is arranged at a position close to the rear cover sidewall 280, on the left cover sidewall 282, and formed in a rectangular cross-sectional shape. Similarly, the right guide protrusion 404 is arranged at a position close to the rear cover sidewall 280, of the right cover sidewall 284, and formed in a rectangular cross-sectional shape.

Also, the rear guide protrusion 400, the left guide protrusion 402 and the right guide protrusion 404 are formed in such a way as to have substantially the same height from the loading base 31, and their height is designed to be lower than the above rib-like regulating portion 168 in the loaded tape cartridge 100. (see FIG. 12B and FIG. 13B). As will be described in detail later, the guide recess 169 corresponding to the guide protrusion 67 is situated below the rib-like regulating portion 168, and the guide recess 169 is designed not to protrude into the ribbon feed path 214. Also, the rear guide protrusion 400, the left guide protrusion 402 and the right guide protrusion 404 are formed (molded) integrally with the head cover 43 and the loading base 31 and function as loading guides for the tape cartridge 100 and as ribs for reinforcing the head cover 43.

Figure 12A:
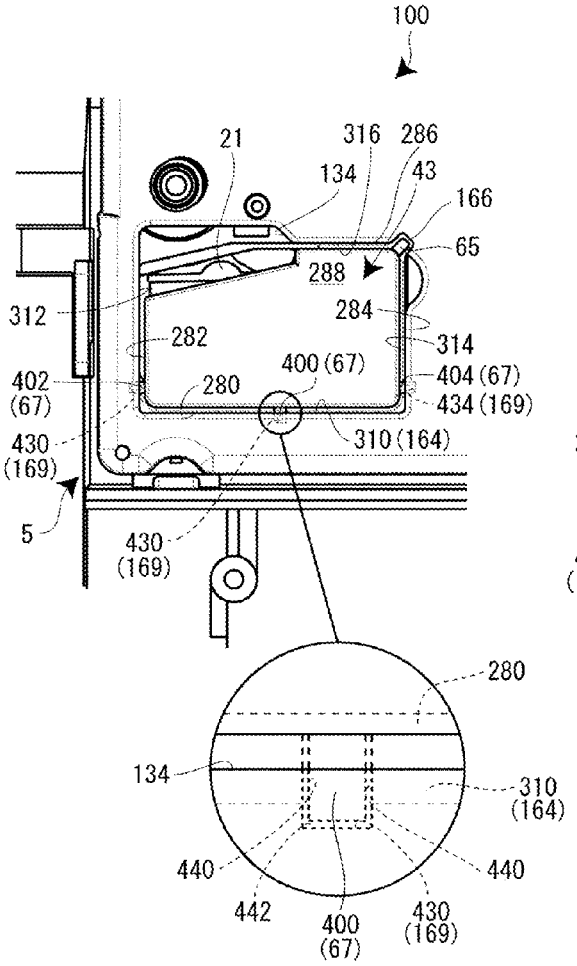
FIG. 12A is an enlarged plan view and FIG. 12B is an enlarged cross-sectional view of the vicinities of an insertion opening in the state where a tape cartridge is loaded in a tape printing device according to a fourth embodiment.
Figure 12B:
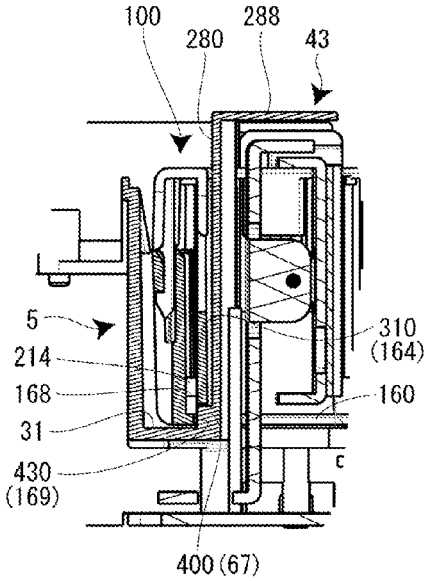
Figure 13A:
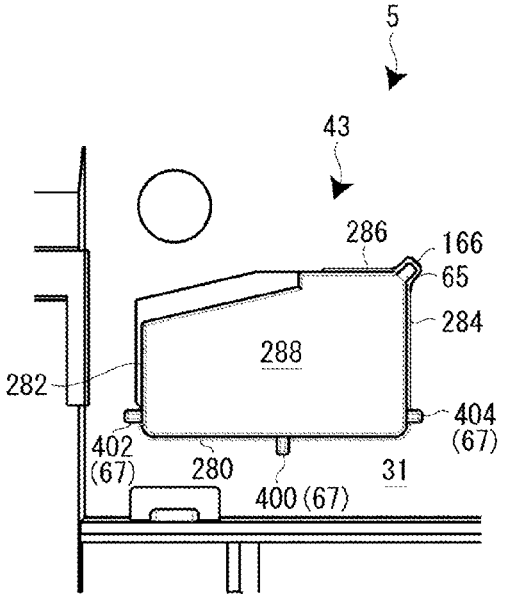
FIG. 13A is an enlarged plan view and FIG. 13B is an enlarged side view of the vicinities of a head cover in cartridge loading section.
Figure 13B:
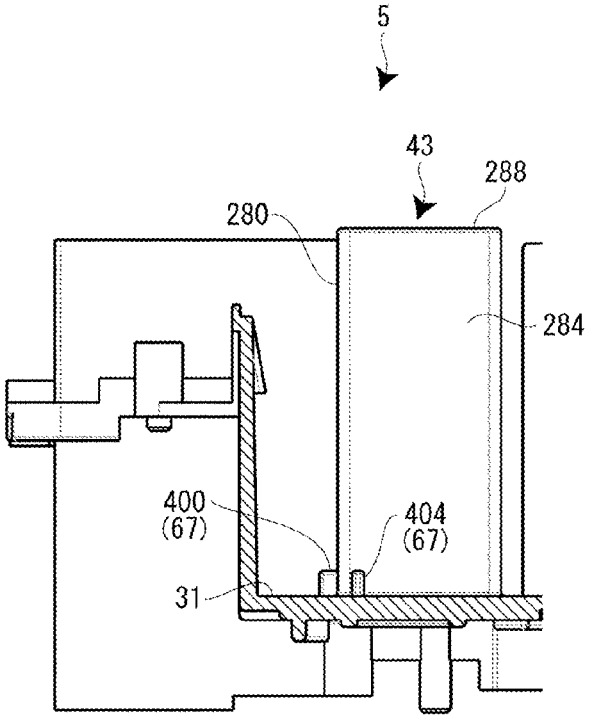
Figure 14:
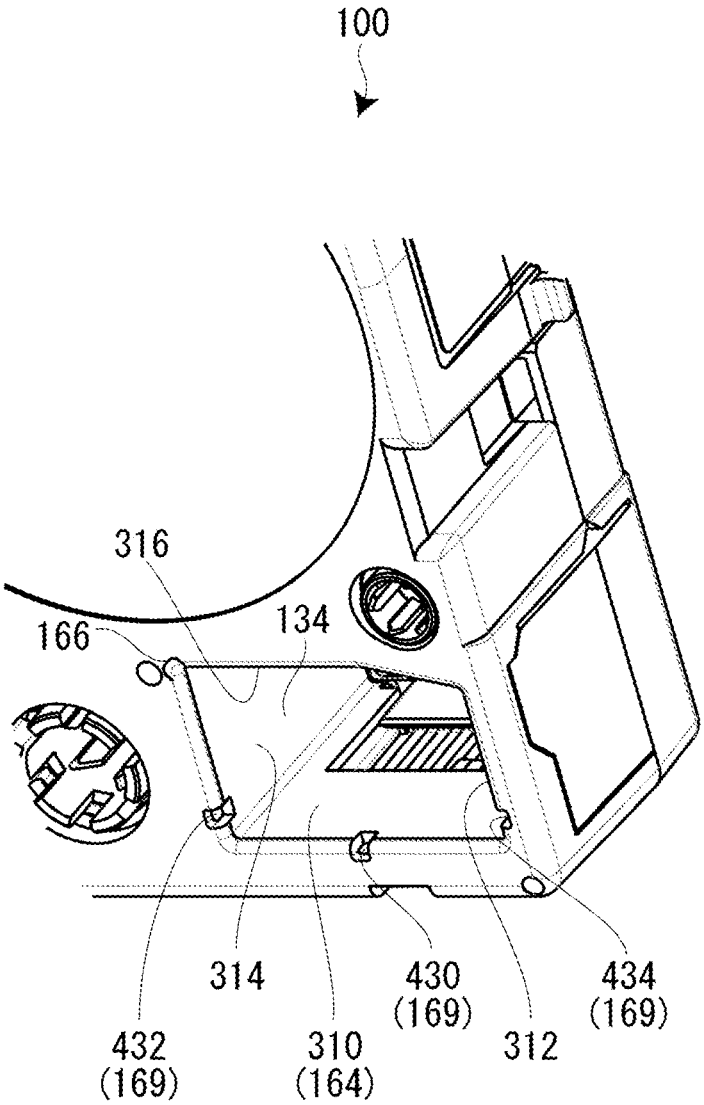
FIG. 14 is an enlarged perspective view of the vicinities of an insertion opening of the tape cartridge.

As shown in the enlarged views of FIGS. 12A, 12B and 14, the three guide recesses 169 of the tape cartridge 100, which receive the three guide protrusions 67, are formed in the opening circumferential wall portion 164.

The three guide recesses 169 have a rear guide recess 430 which is formed in the rear opening inner wall 310 and with which the rear guide protrusion 400 is fitted, a left guide recess 432 which is formed in the left opening inner wall 312 and with which the left guide protrusion 402 is fitted, and a right guide recess 434 which is formed in the right opening inner wall 314 and with which the right guide protrusion 404 is fitted. Then, the rear guide recess 430 is formed in a rectangular cross-sectional shape which is a complementary shape to the rear guide protrusion 400 with a rectangular cross section. Also, the left guide recess 432 is formed in a rectangular cross-sectional shape which is a complementary shape to the left guide protrusion 402. Similarly, the right guide recess 434 is formed in a rectangular cross-sectional shape which is a complementary shape to the right guide protrusion 404.

In this case, each of the rear guide recess 430, the left guide recess 432 and the right guide recess 434 has two recess sidewall surfaces 440 parallel to each other, and these two recess sidewall surfaces 440 contact the lateral sides of each guide protrusion 67. Thus, the rear guide recess 430 is positioned in the left-right direction (direction orthogonal to the protruding direction) by the rear guide protrusion 400. Similarly, the left guide recess 432 is positioned in the forward-rear direction (direction orthogonal to the protruding direction) by the left guide protrusion 402, and the right guide recess 434 is positioned in the forward-rear direction (direction orthogonal to the protruding direction) by the right guide protrusion 404.

Also, each of the rear guide recess 430, the left guide recess 432 and the right guide recess 434 has a recess bottom wall surface 442 including the upward slope surface in the loading direction (see FIG. 12B). Thus, when the tape cartridge 100 is loaded in the cartridge loading section 5, the displacement of the rear guide recess 430 in the direction in which the rear guide protrusion 400 protrudes is regulated by the rear guide protrusion 400. This pressing force is transmitted to the tape cartridge 100 via the upper bearing portion 232 and the lower bearing portion 234 of the platen roller 120, for example, and acts to displace the rear guide recess 430 toward the rear guide protrusion 400. However, the displacement is regulated by the rear guide protrusion 400. Similarly, the left guide recess 432 is regulated in its position to the left by the left guide protrusion 402, and the right guide recess 434 is regulated in its position to the right by the right guide protrusion 404. Therefore, the tape cartridge 100 is positioned firmly in the left-right direction.

Meanwhile, the rear guide recess 430, the left guide recess 432 and the right guide recess 434 are formed to substantially the same height from the bottom wall portion 160, and their height is designed to be slightly lower than the above rib-like regulating portion 168 (see FIG. 12B). Thus, the three guide recesses 169 are designed not to protrude into the ribbon feed path 214.

Then, in practice, each of the rear guide recess 430, the left guide recess 432 and the right guide recess 434 is arranged in a corner part 450 where the opening circumferential wall portion 164 and the bottom wall portion 160 intersect with each other (see FIG. 12B and FIG. 14). These recesses 430, 432, 434 are formed as recessed grooves in the corner portion 450 and are formed as openings on the side of the opening circumferential wall portion 164 (inner wall main body). Thus, the three guide recesses 169 can be formed easily without impairing their functions.

Thus, as the tape cartridge 100 is loaded in the cartridge loading section 5, the three guide recesses 169 of the tape cartridge 100 are fitted with the three guide protrusions 67 of the head cover 43, respectively, and the tape cartridge 100 is positioned in the cartridge loading section 5. Therefore, even when the pressing force of the print head 21 or the rotational forces (moments of rotation) of the platen drive shaft 45 and the take-up drive shaft 47 act on the tape cartridge 100, the tape cartridge 100 does not become misaligned. Thus, the misalignment of the tape cartridge 100 can be restrained. Thus, a reduction in the print quality due to the misalignment of the tape cartridge 100 can be prevented.

Also, since the loading of the tape cartridge 100 is guided by the collaboration of the guide protrusions 67 and the guide recesses 169, the spacing between the head cover 43 and the insertion opening 134 can be minimized and the entry of dust or the like from this part can be effectively prevented.

[Structure Around Main Body-Side Abutting Portion: Fifth Embodiment]

Next, referring to FIG. 15, the structure around the main body-side abutting portion 65 of the head cover 43 according to the fifth embodiment will be described. In this fifth embodiment, different parts from the fourth embodiment will be mainly described.

Figure 15:
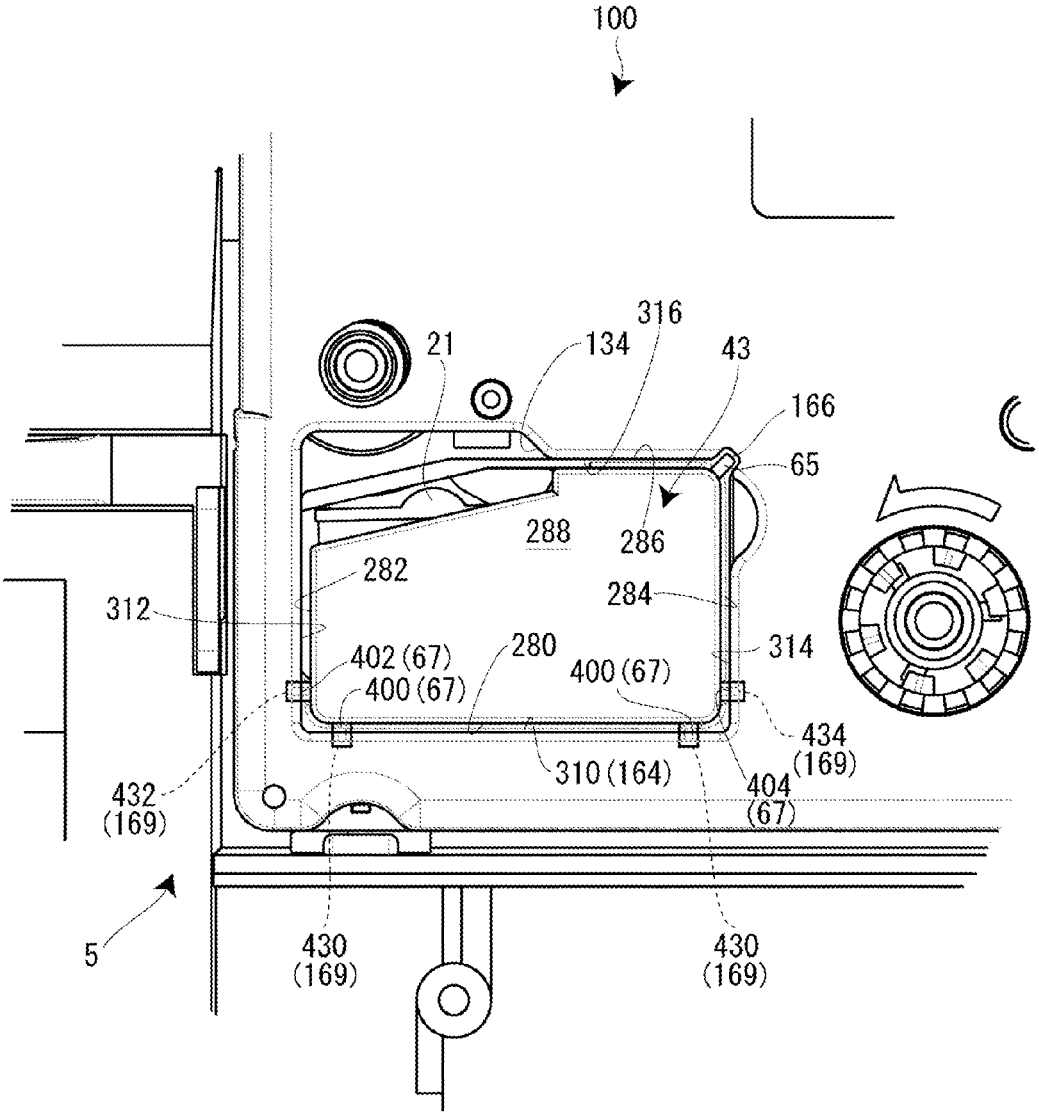
FIG. 15 is an enlarged plan view of the vicinities of an insertion opening in the state where a tape cartridge is loaded in a tape printing device according to a fifth embodiment.

As shown in FIG. 15, in this embodiment, four guide protrusions 67 are provided on the head cover 43, and corresponding to these, four guide recesses 169 are provided in the opening circumferential wall portion 164 of the tape cartridge 100.

The four guide protrusions 67 include two rear guide protrusions 400 provided in a protruding manner on the outer surface of the rear cover sidewall 280, a left guide protrusion 402 provided in a protruding manner on the outer surface of the left cover sidewall 282, and a right guide protrusion 404 provided in a protruding manner on the outer surface of the right cover sidewall 284. One rear guide protrusion 400 and the left guide protrusion 402 are arranged near the corner between the rear cover sidewall 280 and the left cover sidewall 282. The other rear guide protrusion 400 and the right guide protrusion 404 are arranged near the corner between the rear cover sidewall 280 and the right cover sidewall 284.

Corresponding to the four guide protrusions 67, the four guide recesses 169 include two rear guide recesses 430 which are formed in the rear opening inner wall 310 and with which the two rear guide protrusions 400 are fitted, a left guide recess 432 which is formed in the left opening inner wall 312 and with which the left guide protrusion 402 is fitted, and a right guide recess 434 which is formed in the right opening inner wall 314 and with which the right guide protrusion 404 is fitted.

In this way, in the one (left) corner of the two corners of the opening circumferential wall portion 164, the one rear guide recess 430 is fitted with the one rear guide protrusion 400, and the left guide recess 432 is fitted with the left guide protrusion 402. Also, in the other (right) corner, the other rear guide recess 430 is fitted with the other rear guide protrusion 400, and the right guide recess 434 is fitted with the right guide protrusion 404. Thus, the two corners of the opening circumferential wall portion 164 are respectively positioned in the forward-rear and left-right directions. That is, the tape cartridge 100 is positioned in the forward-rear and left-right directions at each of the two positions spaced apart from each other near the print head 21.

In the fifth embodiment as described above, too, as the tape cartridge 100 is loaded in the cartridge loading section 5, the four guide recesses 169 of the tape cartridge 100 are fitted respectively with the four guide protrusions 67 of the head cover 43, and the tape cartridge 100 is firmly positioned in the cartridge loading section 5. Therefore, even when an external force acts on the tape cartridge 100, its misalignment is prevented and a reduction in the print quality due to the misalignment of the tape cartridge 100 can be prevented.

In the fourth and fifth embodiments, the numbers of the guide protrusions 67 and the guide recesses 169 are arbitrary. Also, the lengths of the guide protrusions 67 and the guide recesses 169 are arbitrary. For example, apart or all of these may be guide protrusions 67 with a length that is the same as the height of the head cover 43, and guide recesses 169 with a length that is the same as the height of the opening circumferential wall portion 164.

The invention claimed is:

1. A tape printing device comprising:

a cartridge loading section in which a tape cartridge is loaded;

a first output unit which is provided in the cartridge loading section and outputs a forward rotational force to feed a print tape of the tape cartridge that is loaded;

a second output unit which is provided in the cartridge loading section and outputs a reverse rotational force to take up an ink ribbon of the tape cartridge that is loaded;

a main body-side abutting portion which is provided in the cartridge loading section and abuts against the tape cartridge that is loaded, so as to resist the rotational forces generated on the tape cartridge by the first output unit and the second output unit; and a print head unit which is provided in the cartridge loading section and performs printing on the print tape, and a head cover which covers the print head unit, wherein the main body-side abutting portion is provided in a protruding manner in a corner of the head cover and abuts against a corner of an opening circumferential wall portion of the tape cartridge where the head cover is inserted.

2. The tape printing device according to claim 1, wherein the main body-side abutting portion is arranged on or near an imaginary line connecting the first output unit and the second output unit.

3. The tape printing device according to claim 1, wherein the first output unit has a platen drive shaft which rotationally drives a platen roller of the tape cartridge for feeding the print tape, and the second output unit has a take-up drive shaft which rotationally drives a take-up core of the tape cartridge for taking up the ink ribbon.

4. The tape printing device according to claim 1, wherein the print head unit has a print head and a swivel support shaft which supports the print head in such a way as to be able to swivel between a printing position and a retreat position, the head cover has a first cover sidewall and a second cover sidewall which cover the side of the swivel support shaft and meet each other, and the main body-side abutting portion is provided in a protruding manner in a corner where the first cover sidewall and the second cover sidewall meet each other.

5. The tape printing device according to claim 4, wherein a cartridge-side abutting portion is provided in a recessed manner in the corner of the opening circumferential wall portion, corresponding to the main body-side abutting portion, and the main body-side abutting portion is relatively fitted with the cartridge-side abutting portion.

6. The tape printing device according to claim 5, wherein the main body-side abutting portion has, in the corner, a first abutting protrusion provided in a protruding manner on the first cover sidewall, and a second abutting protrusion provided in a protruding manner on the second cover sidewall, the first abutting protrusion is fitted with a first abutting recess of the cartridge-side abutting portion, and the second abutting protrusion is fitted with a second abutting recess on the cartridge-side abutting portion.

7. The tape printing device according to claim 4, further comprising a guide protrusion which is provided in a protruding manner on an outer circumferential surface of the head cover and guides the loading of the tape cartridge via a recess to be guided which is formed in the tape cartridge.

8. The tape printing device according to claim 7, wherein the recess to be guided is relatively fitted with the guide protrusion.

9. The tape printing device according to claim 7, wherein the head cover is situated on a back side of the print head, and further includes a third cover sidewall opposite the first cover sidewall, and a fourth cover sidewall opposite the second cover sidewall, the third cover sidewall extends in a direction that is the same as a direction of feeding the print tape, and the guide protrusion has a first protrusion provided in a protruding manner on an outer surface of the third cover sidewall.

10. The tape printing device according to claim 9, wherein the guide protrusion has a second protrusion provided in a protruding manner on an outer surface of the second cover sidewall, and a third protrusion provided in a protruding manner on an outer surface of the fourth cover sidewall.

11. A tape printing system comprising:

the tape printing device according to claim 1; and the tape cartridge loaded in the cartridge loading section in an unloadable manner.

* * * * *